United States Patent [19]

Yamamoto et al.

[11] Patent Number: 5,014,644

[45] Date of Patent: May 14, 1991

[54] APPARATUS FOR COATING AUTOMOTIVE BODY

[75] Inventors: Toru Yamamoto; Daizo Shiga; Kenichi Chujyo; Eiji Kikuchi; Masayuki Enomoto; Masaaki Syoji; Kiyohiro Ichinose; Kyuya Yamazaki, all of Sayama, Japan

[73] Assignee: Honda Giken Kogyo Kabushiki Kaisha, Tokyo, Japan

[21] Appl. No.: 355,682

[22] Filed: May 23, 1989

[51] Int. Cl.[5] ..... B05B 1/14; B05B 9/06

[52] U.S. Cl. ..... 118/314; 118/315; 118/323

[58] Field of Search ..... 118/314, 315, 316, 317, 118/323, 324, 326

[56] References Cited

U.S. PATENT DOCUMENTS

| | | | |
|---|---|---|---|
| 2,900,950 | 8/1959 | Peeps | 118/680 |
| 3,027,273 | 3/1962 | Sacks | 427/10 |
| 3,402,697 | 10/1968 | Kock | 118/624 |
| 3,496,908 | 2/1970 | Bernardi | 118/684 |
| 3,509,852 | 5/1970 | Wells | 118/323 |
| 3,533,422 | 10/1970 | Alimanestiano | 118/668 |
| 3,619,311 | 11/1971 | Rose et al. | 156/62 |
| 3,742,906 | 7/1973 | Dupke | 118/105 |
| 3,924,565 | 12/1975 | Benner et al. | 118/323 |
| 4,209,557 | 6/1980 | Edwards | 427/373 |
| 4,278,046 | 7/1981 | Clark et al. | 118/695 |
| 4,590,654 | 5/1986 | Kajiura | 29/407 |
| 4,702,666 | 10/1987 | Iwao et al. | 118/326 |
| 4,714,044 | 12/1987 | Kikuchi et al. | 118/314 |
| 4,721,630 | 1/1988 | Takeo et al. | 118/314 |
| 4,768,462 | 9/1988 | Kuronaga et al. | 118/314 |
| 4,869,935 | 9/1989 | Hayashi et al. | 118/314 |

FOREIGN PATENT DOCUMENTS

| | | | |
|---|---|---|---|
| 806765 | 12/1958 | European Pat. Off. . | |
| 84523A3 | 7/1983 | European Pat. Off. . | |
| 0192338 | 8/1986 | European Pat. Off. | 118/314 |
| 552441 | 6/1978 | Japan . | |
| 56-144763 | 4/1980 | Japan . | |
| 5895558 | 11/1981 | Japan . | |
| 5915469 | 7/1982 | Japan . | |
| 59-106586 | 1/1983 | Japan . | |
| 60-148187 | 3/1984 | Japan . | |
| 61-222566 | 3/1985 | Japan . | |
| 1322861 | 7/1983 | United Kingdom . | |
| 2200304 | 8/1988 | United Kingdom . | |

*Primary Examiner*—Jay H. Woo
*Assistant Examiner*—Jeremiah F. Durkin, II
*Attorney, Agent, or Firm*—Birch, Stewart, Kolasch & Birch

[57] ABSTRACT

An automotive body delivered in a direction, and covers such as an engine hood and a trunk lid and doors of the automotive body are opened and held in an open position. Thereafter, prescribed areas of the automotive body are coated, and those doors which are located downstream with respect to the direction in which the automotive body is delivered and those areas of the automotive body which correspond to those doors which are located upstream with respect to the same direction, are coated. Thereafter, the covers and the doors of the automotive body are closed.

7 Claims, 17 Drawing Sheets

APPARATUS FOR COATING AUTOMOTIVE BODY

BACKGROUND OF THE INVENTION

The present invention relates to a method of and an apparatus for coating an automotive body, and more particularly to a method of and an apparatus for coating an automotive body automatically and efficiently by opening the doors and engine hood of the automotive body delivered along a conveyor line, thereafter coating inner panels of the automotive body, and closing the doors and engine hood.

Automotive bodies generally include coated outer panels which provide outer automobile appearances and also coated inner panels which are normally concealed from external view, such as inner peripheral walls of doors, body portions corresponding to the inner peripheral walls of the doors, reverse sides of an engine hood and a trunk lid, and inner walls of an engine compartment and a trunk.

In order to coat the inner peripheral walls of the doors and the corresponding body portions, it is necessary to open and close the doors. If other coated surfaces of the automotive body are not yet dried enough, the coating layers on these coated surfaces tend to be damaged when the doors are opened and closed.

Various arrangements have heretofore been proposed to open and close doors while avoiding damage to coated surfaces of automotive bodies. According to one conventional scheme disclosed in Japanese Laid-Open Patent Publication No. 58-95558, an engaging member is mounted on an angularly and vertically movable arm and brought into an window glass receiving slot in an automobile door or engaged by an auxiliary jig inserted in the window glass receiving slot. The door can then be opened and closed by displacing the arm.

When the arm is displaced to cause the engaging member to engage in the window glass receiving slot, it is highly difficult to guide the engaging member accurately into the window glass receiving slot since the opening of the window glass receiving slot is considerably narrow. Moreover, automotive bodies may not always be delivered into a correct position, and doors may be opened to irregular angular extents depending on different automotive bodies.

If the auxiliary jig is to be mounted in the window glass receiving slot, then it is necessary to attach the auxiliary jig to the door in advance. Therefore, the efficiency of operation is poor, and it is impossible to provide a highly efficient, automated coating process.

Apparatus for opening and closing various covers such as engine hoods, trunk lids, or the like are disclosed in Japanese Laid-Open Utility Model Publications Nos. 55-2441, 59-15469, 59-106586, for example. The cover opening and closing apparatus disclosed in Japanese Laid-Open Utility Model Publication No. 55-2441 has an actuatable arm extending from a structural member disposed above an automotive conveyor apparatus. According to Japanese Laid-Open Utility Model Publication No. 59-15469, an arm is mounted on a coating station movable alongside of and parallel to an automotive body conveyor apparatus, and movable in overhanging relation to an automotive body to open and close a cover thereof. In each of the disclosed arrangements, the arm is lowered from above the automotive body, caused to grip a portion of the cover, and then displaced upwardly to open the cover.

However, these disclosed systems have had various problems as described below. While the automobile assembling plant is in operation, dust suspended in the space in the plant is deposited on the arm. When the arm is lowered toward an automotive body, the deposited dust on the arm falls onto the automotive body, contaminating a surface to be coated of the automotive body. The surface to be coated of the automotive body is cleaned before a coating layer is applied thereto, and any dust or foreign matter attached to the surface will cause a serious coating problem when the coating layer is applied. Oil or grease supplied to articulations of the arm also tends to drop onto the automotive body, resulting in a coating failure.

A cover holding apparatus for holding the opened cover in a prescribed angular position is disclosed in Japanese Laid-Open Utility Model Publication No. 60-148187, for example. The disclosed cover holding apparatus comprises a first rod member having one end supported on a carriage for placing an automotive body thereon, and a second rod member angularly movably engaging the other end of the first rod member and engageable with the reverse side of the cover. The first and second rod members can be locked to each other at respective angular positions by means of a locking means including a spring.

The cover holding apparatus of this type is however large and heavy, cannot easily be handled, and may damage outer panels of automotive bodies when it is attached to and detached from covers.

Articulated coating robots have widely been used for coating inner panels of automotive bodies. An articulated coating robot is normally installed on the floor in a coating booth. Therefore, a space for installing the coating robot must be provided on the floor in the coating booth. As a consequence, the coating booth is large in size, and the floor thereof disturbs a stream of air which flows downwardly in the coating booth to prevent paint mists from being scattered. With a view to solving this problem, there has been proposed a coating apparatus in which only an arm with a paint spray gun mounted on its distal end is inserted in a coating booth (see Japanese Laid-Open Patent Publication No. 61-222566). With only the arm inserted in the coating booth, however, the range of movement of the nozzle of the paint spray gun is limited to a considerably small range.

When doors of an automotive body and corresponding inner panel portions of the automotive body are coated by a coating robot, a plurality of paint spray nozzles are directed toward front and rear doors and coat them simultaneously, and a plurality of other paint spray nozzles are also directed to automotive body portions and coat them simultaneously. The paint spray nozzles eject paint sprays while they are very close to each other, ejected paint sprays tend to be applied to the nozzles and the arms.

SUMMARY OF THE INVENTION

It is a primary object of the present invention to provide a method of and an apparatus for coating an automotive body by automatically and efficiently applying paint coatings to inner panels of the automotive body.

Another object of the present invention is to provide a method of coating an automotive body, comprising the steps of: stopping the automotive body in a given position in a station, with covers and doors of the automotive body being open; coating reverse sides of the covers, inner panels of the automotive body which correspond to the covers, inner panels of the doors, and inner panels of the automotive body which correspond to the doors; and delivering the automotive body to a next station.

Still another object of the present invention is to provide a method of coating an automotive body, comprising the steps of: delivering the automotive body in a direction; opening covers and doors of the automotive body and holding them in an open position; thereafter coating prescribed areas of the automotive body; coating those doors which are located downstream with respect to said direction and those areas of the automotive body which correspond to those doors which are located upstream with respect to said direction; and closing said covers and said doors.

Still another object of the present invention is to provide a method of coating an automotive body, comprising the steps of: stopping the automotive body in a prescribed position on a conveyor line or delivering the automotive body along the conveyor line; placing an engaging member in a handle attachment opening in a door of the automotive body; displacing the engaging member along a substantially arcuate path about hinges of said door to open the door with respect to the automotive body; thereafter coating prescribed areas of the automotive body; and closing said door with respect to the automotive body.

Yet another object of the present invention is to provide an apparatus for coating an automotive body, comprising: a coating station for coating inner panels of the automotive body which is stopped with covers and doors open; said coating station including a first coating mechanism disposed on one side of the automotive body for coating the reverse side of one of the covers, an inner panel of the automotive body which corresponds to said one cover, an inner panel of the door on said one side, and an inner panel of the automotive body which corresponds to the door on said one side, and a second coating mechanism disposed on the other side of the automotive body for coating the reverse side of the other cover, an inner panel of the automotive body which corresponds to said other cover, an inner panel of the door on said other side, and an inner panel of the automotive body which corresponds to the door on said other side.

Yet still another object of the present invention is to provide the apparatus for coating an automotive body, wherein two said first coating mechanisms and two said second coating mechanisms are juxtaposed in a direction in which the automotive body is delivered in the coating station.

Still another object of the present invention is to provide the apparatus for coating an automotive body, wherein said automotive body has four doors, said first and second coating mechanisms having two door spray guns for coating inner panels of the front and rear doors and inner panels of the automotive body which correspond to the front and rear doors.

Yet another object of the present invention is to provide an apparatus for coating an automotive body, comprising: a door opening/closing mechanism for opening and closing a door of the automotive body when the automotive body is to be coated; and said door opening/closing mechanism including at least one arm angularly movable by a first actuator, and an engaging member mounted on a distal end of said arm and movable back and forth by a second actuator, for engaging in a handle attachment opening in said door.

Yet still another object of the present invention is to provide an automotive body coating apparatus wherein said door opening/closing mechanism comprises a base, a first arm angularly movable with respect to said base by said first actuator, and a second arm angularly movable with respect to said first arm by a third actuator, said engaging member being mounted on said second arm.

A further object of the present invention is to provide an automotive body coating apparatus wherein said first and third actuators are mounted on said base, said first arm being rotatable by said first actuator, said second arm being angularly movably supported on a distal end of said first arm and angularly movable by said third actuator through rotation transmitting means.

A still further object of the present invention is to provide an automotive body coating apparatus wherein said first through third actuators comprise first through third rotative drive sources, respectively, said rotation transmitting means comprising a belt and pulley combination for transmitting rotation of said third rotative drive source to said second arm.

A yet further object of the present invention is to provide an automotive body coating apparatus further including a screw member coupled to said second rotative drive source and rotatable about its own axis for moving said engaging member back and forth.

It is also an object of the present invention to provide an apparatus for coating an automotive body, comprising: a conveyor line for delivering the automotive body; a door opening/closing mechanism for opening and closing a cover of the automotive body when the automotive body is to be coated; and said door opening/closing mechanism including a base disposed alongside of said conveyor line below the automotive body, first and second actuators mounted on said base, a first arm having one end angularly movably supported on said base and angularly movable by said first actuator in a plane substantially parallel to one side of the automotive body, a second arm mounted on the other end of said first arm and angularly movable by said second actuator in a plane which is substantially the same as the plane in which said first arm is angularly movable, a third arm mounted on a distal end of said second arm and angularly movable by a third actuator in a direction normal to the side of the automotive body, and gripper means mounted on a distal end of said third arm for gripping a handle on the cover of the automotive body.

Another object of the present invention is to provide an automotive body coating apparatus wherein said first and second actuators comprise first and second rotative drive sources, respectively, said second arm being operatively coupled to said second rotative drive source by a belt and pulley combination.

Still another object of the present invention is to provide an automotive body coating apparatus wherein said third actuator comprises a cylinder, said cylinder and said third arm being operatively coupled to each other through link means.

Yet another object of the present invention is to provide an apparatus for coating an automotive body, comprising: a cover holder mechanism for holding a cover of the automotive body in a predetermined angular position when the automotive body is to be coated; and said cover holder mechanism including a base, a first connecting member mounted on said base, a second connecting member having one end angularly movably coupled to said first connecting member and the other end positioned for engaging the cover, a third connecting member having one end angularly movably mounted on an intermediate portion of said second connecting member and also having a stopper pin mounted on the other end thereof for entering an opening defined in said first connecting member, and locking means for locking said stopper pin in a prescribed position in said opening, the arrangement being such that when the cover reaches a predetermined open position with respect to the automotive body, the stopper pin is locked by said locking means to prevent said cover from being closed, and said stopper pin can automatically be released from said locking means to allow the cover to be closed by angularly moving said cover further in an opening direction.

Yet still another object of the present invention is to provide an automotive body coating apparatus wherein said locking means comprises a locking member angularly movable in said opening in said first connecting member under the bias of a resilient member, said first connecting member including an engaging opening defined therein in communication with said opening for holding said stopper pin therein, the arrangement being such that by opening said cover, said stopper pin is guided along one side of said engaging member and engages in said engaging opening to fix said cover in a predetermined open position, and by further opening said cover, said stopper pin is moved out of said engaging opening and guided along another surface of said engaging member to allow said cover to be closed.

A further object of the present invention is to provide an automotive body coating apparatus further including a first fixed member fastened to the automotive body, said first connecting member being angularly movably mounted on said first fixed member, and a second fixed member fastened to the cover, said second connecting member being angularly movably mounted on said second fixed member.

A still further object of the present invention is to provide an apparatus for coating an automotive body, comprising: a coating booth for coating the automotive body after a cover and a door thereof have been opened; and a coating mechanism mounted on an inner wall surface of said coating booth in overhanging relation.

A yet further object of the present invention is to provide an automotive body coating apparatus wherein said coating booth includes a rail mounted on said inner wall surface and extending in a direction in which the automotive body is delivered, said coating mechanism being movable back and forth on said rail.

A yet still further object of the present invention is to provide an automotive body coating apparatus wherein said coating mechanism includes a fixed base mounted on the inner wall surface of said coating booth.

The above and other objects, features and advantages of the present invention will become more apparent from the following description when taken in conjunction with the accompanying drawings in which preferred embodiments of the present invention are shown by way of illustrative example.

DETAILED DESCRIPTION OF THE PREFERRED EMBODIMENTS

Figure 1:
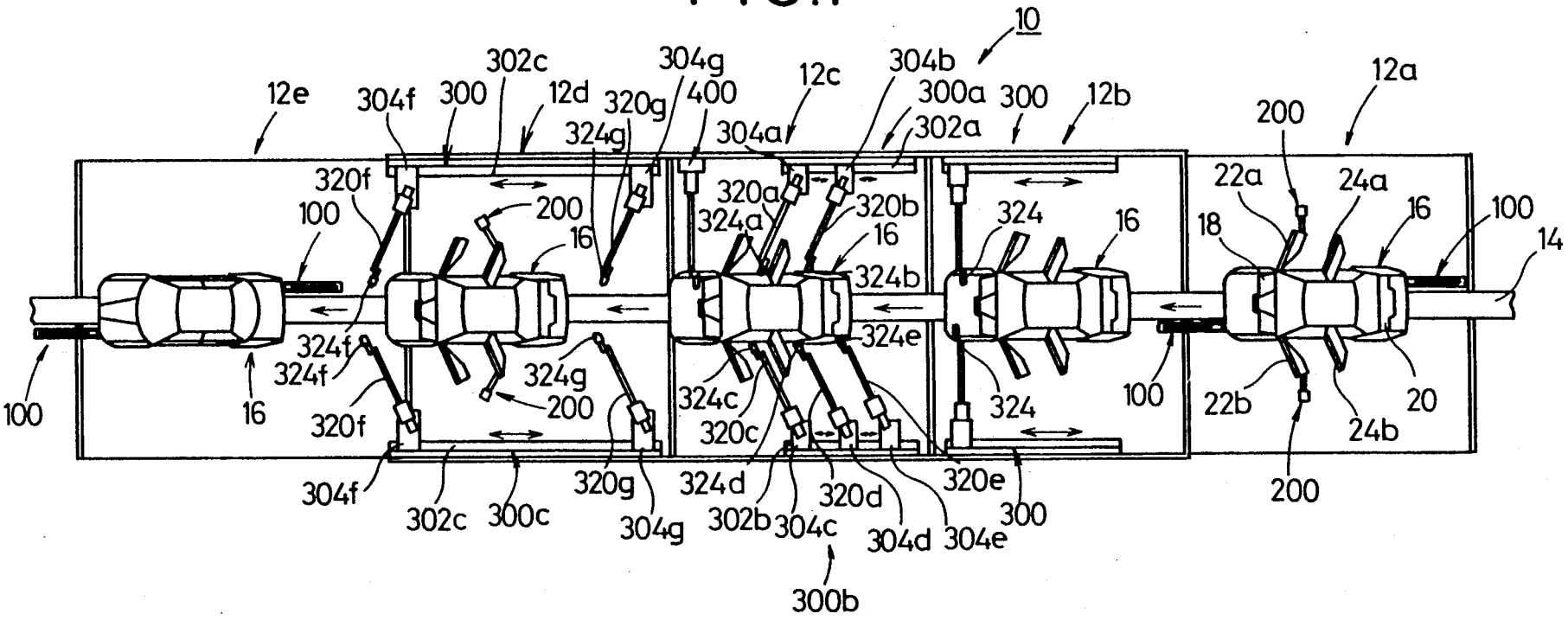
FIG. 1 is a schematic plan view of a coating line incorporating a coating apparatus according to the present invention.
Figure 5:
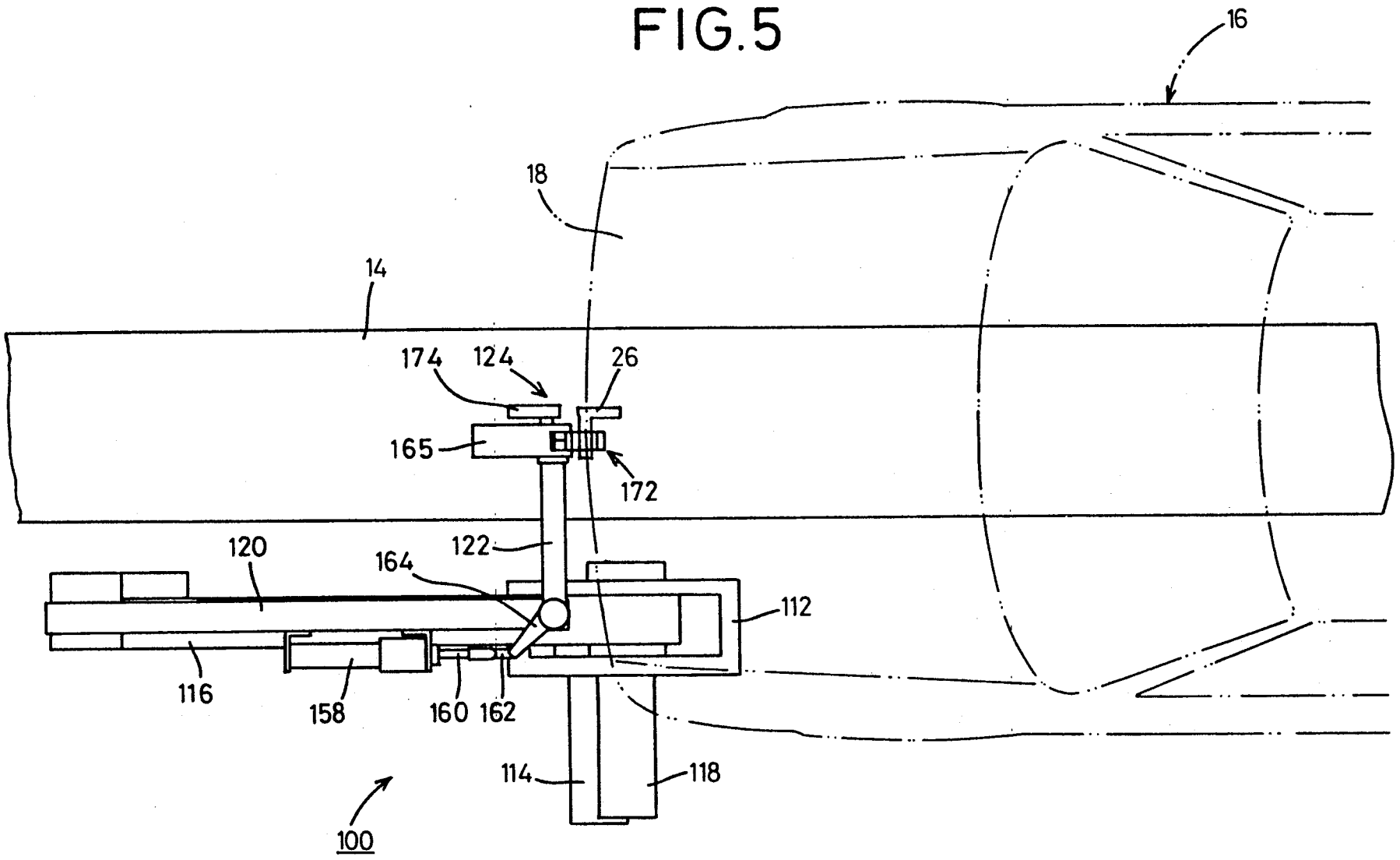
FIG. 5 is a plan view showing the positional relationship between the cover opening/closing mechanism and an automotive body which is delivered by a conveyor.

FIG. 1 shows a coating line 10 incorporating a coating apparatus for carrying out a method of coating an automotive body according to the present invention. The coating line 10 essentially comprises first through fifth stations 12*a* through 12*e* disposed along a conveyor 14 for delivering an automotive body 16 in the direction indicated by the arrows. The automotive body 16 has an engine hood 18, a trunk lid 20, front doors 22*a*, 22*b*, and rear doors 24*a*, 24*b*. Handles 26 (FIGS. 5, 7) are attached to the engine hood 18 and the trunk lid 20, and handle attachment openings 28*a* through 28*d* (FIGS. 10 through 13) are defined in the front and rear doors 22*a*, 22*b*, 24*a*, 24*b*.

The automotive body 16 with cover holder mechanisms 30 mounted respectively on the engine hood 18 and the trunk lid 20 is delivered to the first station 12*a*. The first station 12*a* has two cover opening/closing mechanisms 100 for opening the engine hood 18 and the trunk lid 20, the cover opening/closing mechanisms 100 being positioned below the conveyor 14 and upstream and downstream in the direction in which the automotive body 16 is delivered. A pair of door opening/closing mechanisms 200 is disposed one on each side of the automotive body 16.

The second station **12*b* has a coating booth 80 (FIGS. 12 and 13) in which there is disposed a pair of movable coating mechanisms 300 that are movable back and forth in the direction in which the automotive body 16 is delivered. The third station 12*c* has a plurality of movable coating mechanisms 300*a*, 300*b* similar to the coating mechanisms 300 and also a single fixed coating mechanism 400. The fourth station 12*d* has a pair of movable coating mechanisms 300*c* and a pair of door opening/closing mechanisms 200. The fifth station 12*e* has a pair of cover opening/closing mechanisms 100. Each of the third through fifth stations 12*c*, 12*d*, 12*e* has a coating booth 80**.

Figure 2:
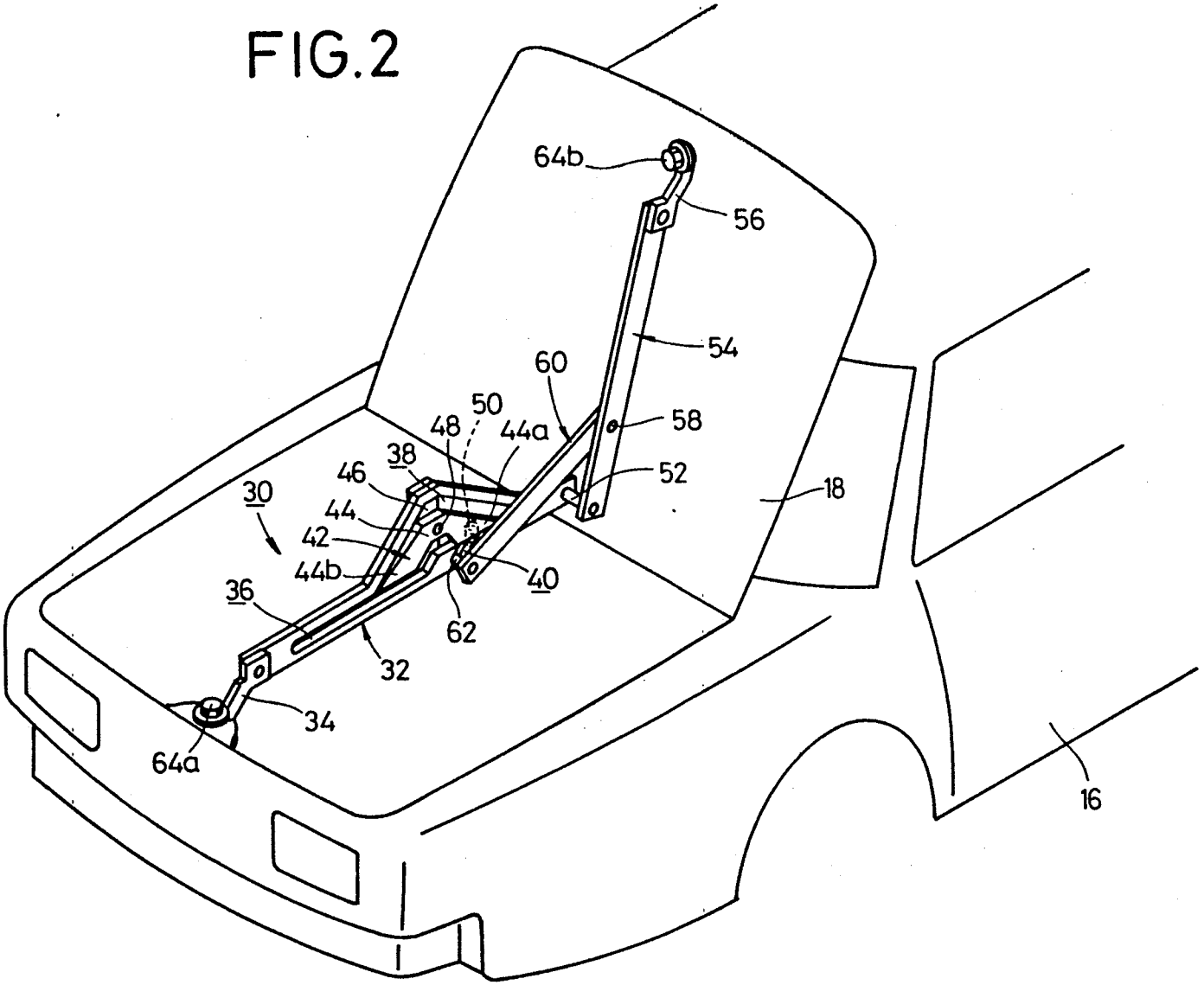
FIG. 2 is a perspective view of a cover holder mechanism of the coating apparatus, the cover holder mechanism being attached to an automotive body.
Figure 3A:
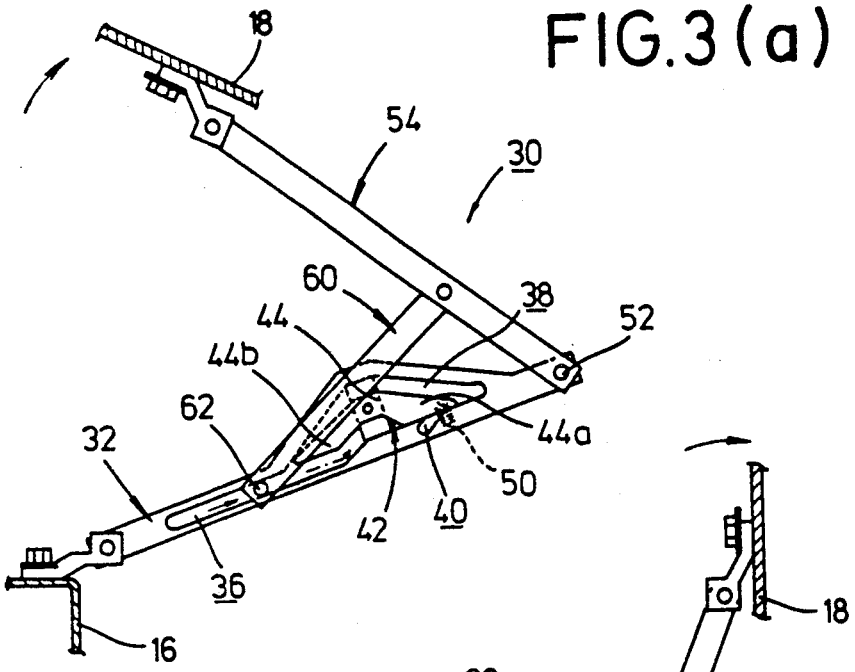
FIGS. 3(*a*) through 3(*c*) are elevational views showing the manner in which the cover holder mechanism operates.
Figure 3B:
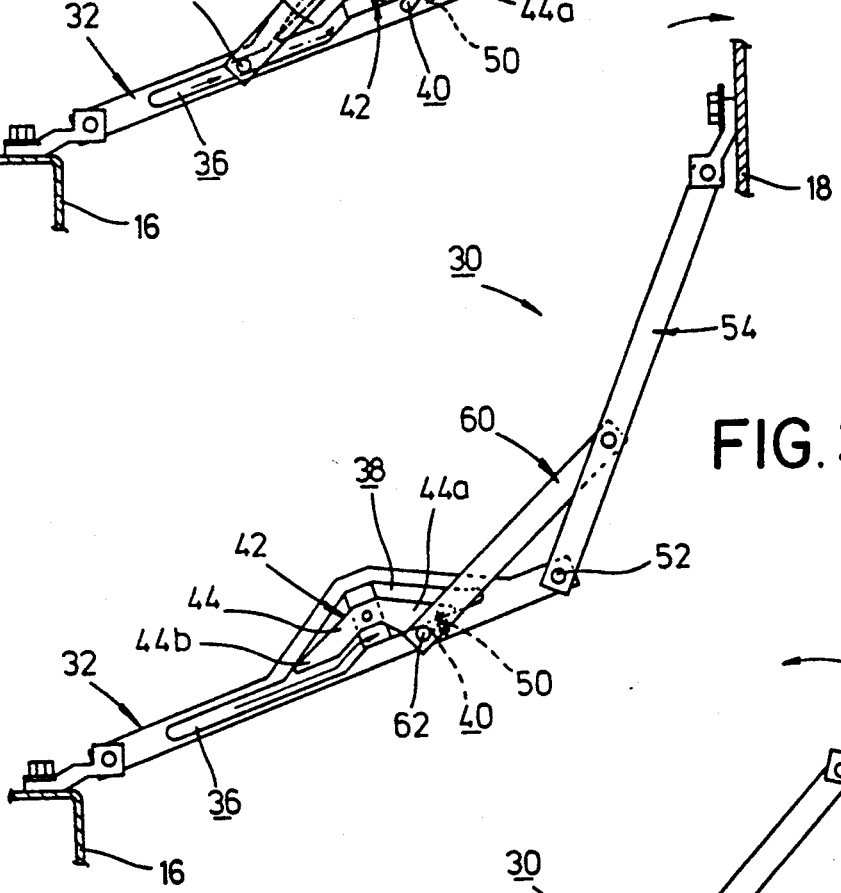
Figure 3C:
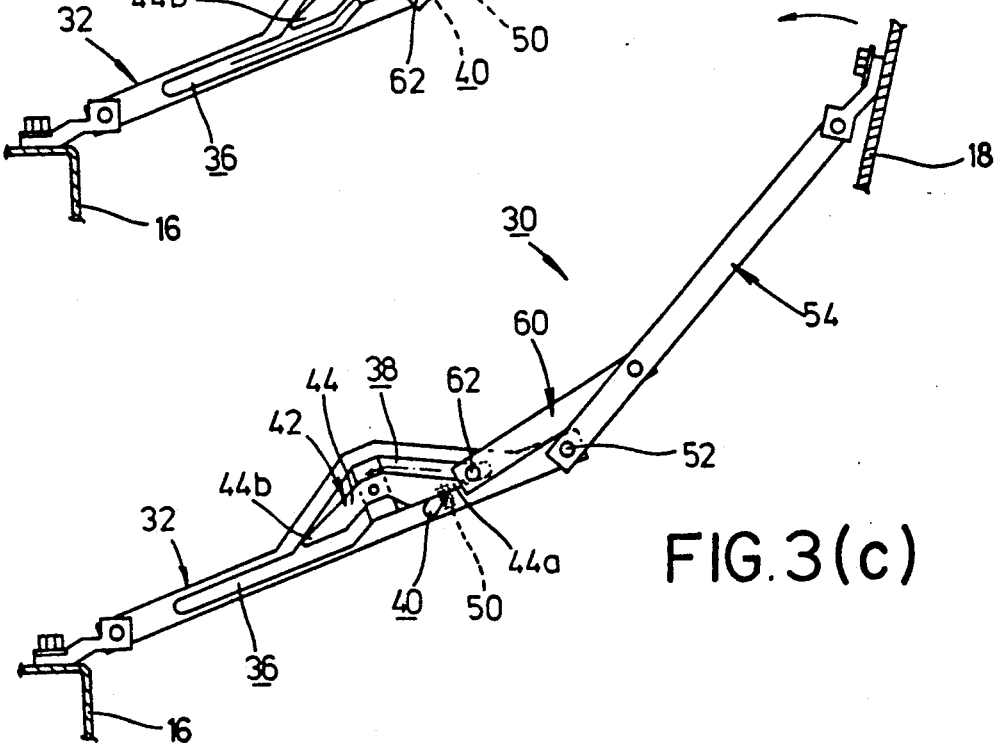
Figure 4:
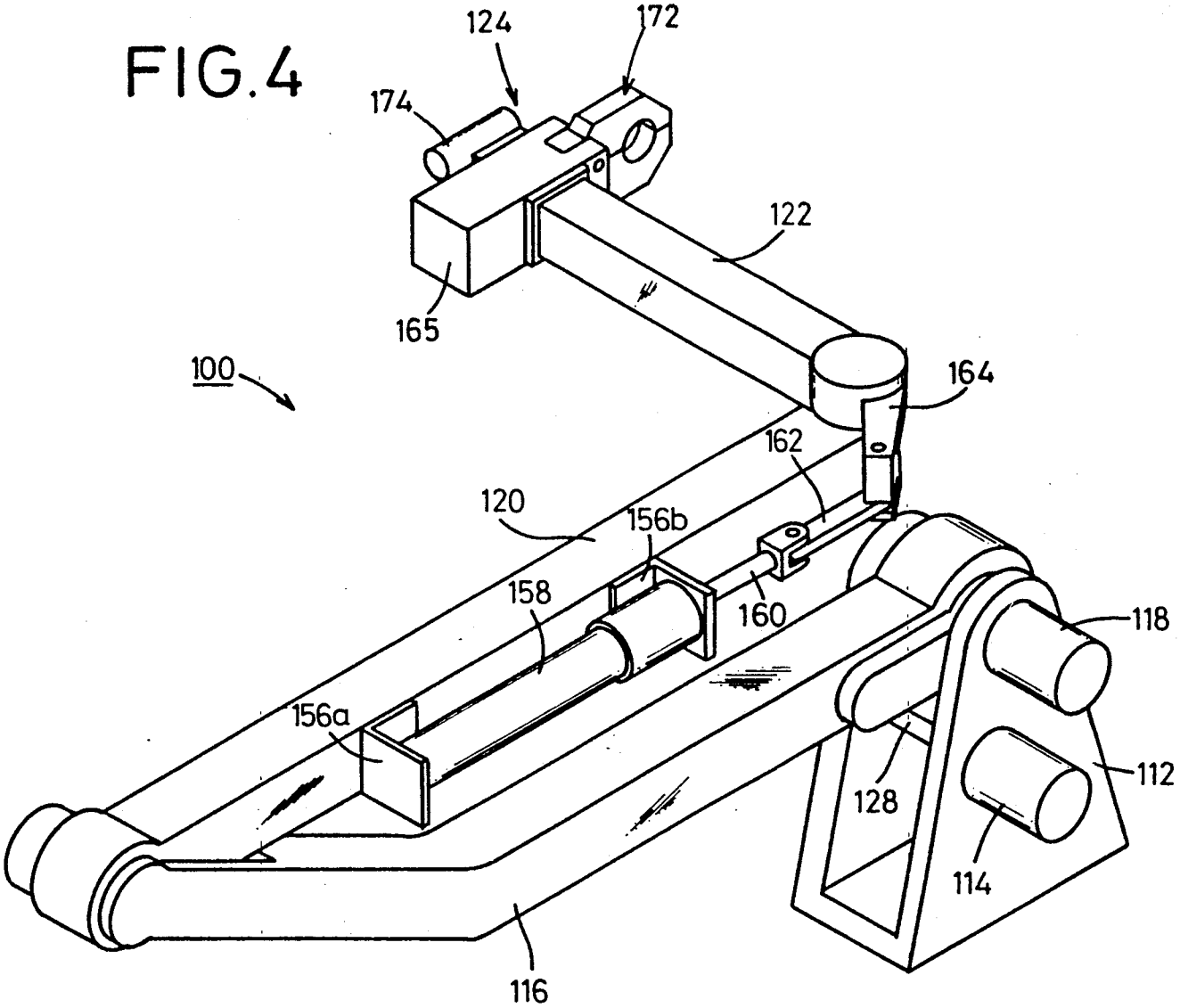
FIG. 4 is a perspective view of a cover opening/closing mechanism of the coating apparatus.

As shown in FIGS. 2 and 3(*a*) through 3(*c*), one of the cover holder mechanism 30 includes a first connecting member 32 in the form of a bent plate and has one end angularly movably coupled to a fixed member 34 secured to an inner wall of the engine compartment of the automotive body 16. The first connecting member 32 has a first oblong opening 36 defined therein and extending from a position near the fixed member 34. The first opening 36 has an end communicating with a second opening 38 which is of a substantially triangular shape complementary to the shape of a portion of the first connecting member 32. A third oblong opening 40 which is inclined to the vertical direction communicates with a lower portion of the second opening 38. A locking means 42 is disposed in the second opening 38.

The locking means 42 includes a locking member 44 which is of a substantially triangular shape complementary to the configuration of the second opening 38. The locking member 44 has an intermediate portion angularly movably supported by a pin 48 on an attachment plate 46 that is fixed to the first connecting member 32. A coil spring 50 is interposed between the first connecting member 32 and an end **44*a* of the locking member 44 near the third opening 40 for normally urging the locking member 44 under tension toward the third opening 40, while holding the other end 44*b* of the locking member 44 against an upper inner wall surface of the first connecting member 32 which defines the second opening 38**.

A second connecting member 54 is angularly movably supported on the other end of the first connecting member 32 by means of a pin 52. The second connecting member 54 has an end angularly movably joined to a fixed member 56 secured to the reverse side of the engine hood 18. A third connecting member 60 has one end angularly movably engaging an intermediate portion of the second connecting member 54 by means of a pin 58. A stopper pin 62 mounted on the other end of the third connecting member 60 is guided and displaced in the first opening 36, the second opening 36, and the third opening 40 in the first connecting member 32 when the engine hood 18 is opened and closed.

The other cover holder mechanism 30, which is of the same structure as the above cover holder mechanism 30, is connected between the automotive body 16 and the trunk lid 20.

As illustrated in FIGS. 4 through 7, each of the cover opening/closing mechanisms 100 comprises a support base 112, a first arm 116 actuatable by a first motor 114 mounted on the support base 112 for angular movement parallel to a vertical plane, a second arm 120 operatively coupled to the distal end of the first arm 116 and actuatable by a second motor 118 mounted on the support base 112 for angular movement in the same vertical plane as the first arm 116, a third arm 122 operatively coupled to the distal end of the second arm 120 and angularly movable in a direction normal to the vertical plane, and a gripper mechanism 124 mounted on the distal end of the third arm 122 for gripping the engine hood 18 or the trunk lid 20 of the automotive body 16 through the handle 26. As can be understood from FIG. 1, the support bases 112 of the cover opening/closing mechanisms 100 are disposed one on each side of and below the conveyor 14.

Figure 6:
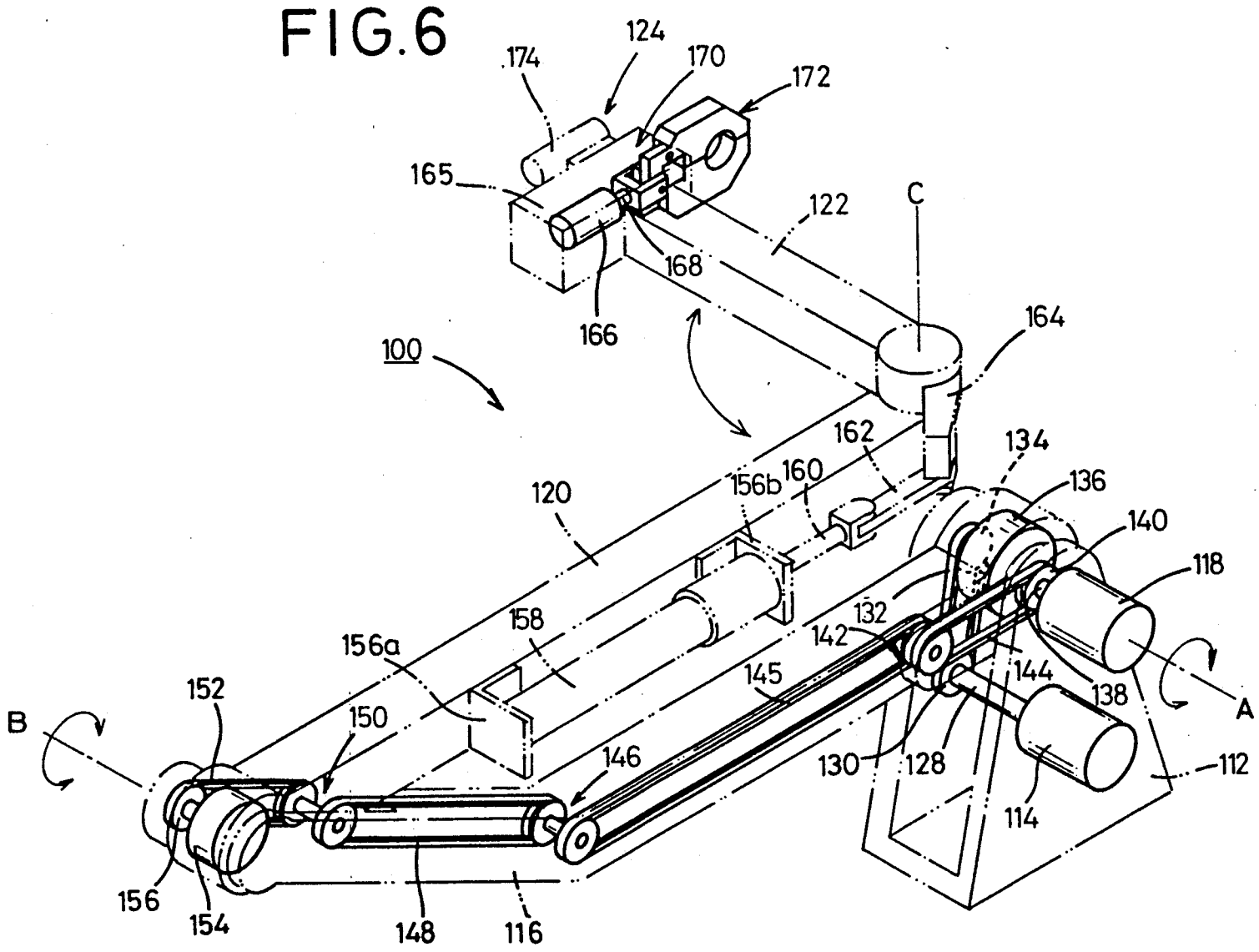
FIG. 6 is a perspective view of an actuating system of the cover opening/closing mechanism.

A system for actuating the cover opening/closing mechanism 100 will be described below with reference to FIG. 6.

The first motor 114 mounted on the support base 112 has a drive shaft 128 on which there is mounted a pulley 130 that is operatively coupled by a belt 132 to a driven pulley 134 mounted on the input shaft of a speed reducer 136. The speed reducer 136 has an output shaft coupled to one end of the first arm 116. Rotation of the first motor 114 is transmitted by the belt 132 to the speed reducer 136 which reduces the speed of rotation transmitted thereto. The arm 116 is thus rotatable in a vertical pane about an axis A at a certain speed.

The second motor 118 mounted on the support base 112 has a drive shaft 138 on which there is mounted a pulley 140 that is operatively coupled by a belt 144 to one of two sheaves of a pulley 142 rotatably supported on the first arm 116. The other sheave of the pulley 142 is operatively coupled by a belt 145 to one of two sheaves of a pulley 146 rotatably supported on the first arm 116. The other sheave of the pulley 146 is operatively coupled by a belt 148 to one sheave of a pulley 150 rotatably mounted on the first arm 116. The other sheave of the pulley 150 is operatively coupled by a belt 152 to a pulley 156 mounted on the input shaft of a speed reducer 154 disposed in the first arm 116. The output shaft of the speed reducer 154 is connected to one end of the second arm 120. Rotation of the second motor 118 is transmitted through the belts 144, 145, 148, 152 to the speed reducer 154 which reduces the speed of rotation transmitted thereto The second arm 120 is therefore rotatable about an axis B at a certain speed in substantially the same vertical plane as the vertical plane in which the first arm 116 is rotatable.

A cylinder 158 is mounted on one side of the second arm 120 by means of brackets **156*a*, 156*b*. The cylinder 158 has a piston rod 160 extending therefrom and having a distal end coupled by a pin to one end of a link 162, the other end of which is joined by a pin to one end of a bar 164 which is inclined at an obtuse angle to the longitudinal axis of the third arm 122. The bar 164 and the third arm 122 are mounted on the distal end of the second arm 120 for unitary angular movement in a direction normal to the vertical plane. When the cylinder 158 is actuated to extend the piston rod 160 to its maximum stroke, the third arm 122 is angularly moved 90° about an axis C from the illustrated position to a position in which the axis of the third arm 122 is aligned with the axis of the second arm 120**.

The gripper mechanism 124 disposed on the distal end of the third arm 122 comprises a cylinder 166 housed in a case 165, a link assembly 170 coupled to the distal end of a piston rod 168 of the cylinder 166, and a chuck 172 actuatable by the cylinder 166 so as to be opened and closed through the link assembly 170. The chuck 172 is of such a shape as to grip the rod-shaped handle 26 mounted on each of the engine hood 16 and the trunk lid 20. A light-reflecting sensor 174 is mounted on an outer side surface of the case 165 for detecting the handle 26 on each of the engine hood 18 and the trunk lid 20.

As shown in FIGS. 8 through 11, each door opening/closing mechanism 200 includes a support base 212 housing therein a first rotative drive source 214 and a second rotative drive source 216. The first rotative drive source 214 serves to angularly displace a first arm 218 which is angularly movably supported at one end on the support base 212. The second rotative drive source 216 serves to angularly displace a second arm 220 operatively coupled to the distal end of the first arm 218.

The first rotative drive source 214 has a vertically upward drive shaft 214*a* with its upper end exposed out of the support base 212. A first sprocket 222 is mounted on the upper end of the drive shaft 214*a*. The end of the first arm 218 is rotatably supported on the support base 212 by means of a bearing 224, and has a hole 226 defined therein coaxially with and above the bearing 224. The hole 226 is defined by a peripheral surface having grooves defining gear teeth, and a gear 228 is fitted in the hole 226. A speed reducer 230 is coupled to the gear 228 and has a vertically upward shaft 231 on which a second sprocket 232 is mounted. A chain 234 is trained around the second sprocket 232 and the first sprocket 222.

The second rotative drive source 216 has a vertically upward drive shaft 216*a* extending into the first arm 218 coaxially with the shaft 231, with a first pulley 236 mounted on the drive shaft 216*a*.

One end of the second arm 220 is rotatably mounted on the upper surface of the other end of the first arm 218 through a bearing 238. The end of the second arm 220 has a hole 240 defined therein coaxially with the bearing 238. The hole 240 is defined by a peripheral surface having grooves defining gear teeth, and a gear 242 is fitted in the hole 240. A speed reducer 244 is coupled to the gear 242 and has a vertically downward shaft 245 extending into the other end of the first arm 218 and coupled to a second pulley 246. A belt 248 is trained around the second pulley 246 and the first pulley 236.

A vertically upwardly extending casing 252 is mounted on the other end of the second arm 220. A third rotative drive source 254 is attached to the lower end of the casing 252. The third rotative drive source 254 has a drive shaft 254*a* to which one end of a ball screw 256 is connected coaxially. The other end of the ball screw 256 is rotatably supported in the casing 252. A nut 258 is threaded over the ball screw 256. A rod 260 is mounted on and extends vertically upwardly from the nut 258 out of the distal end of the casing 252. An attachment member 262 is fixed to the upper end of the rod 260. One end of a horizontally extending rod 264 is joined to the attachment member 262. An engaging member 266 which extends vertically upwardly over a predetermined length is attached to the other end of the rod 264.

Figure 12:
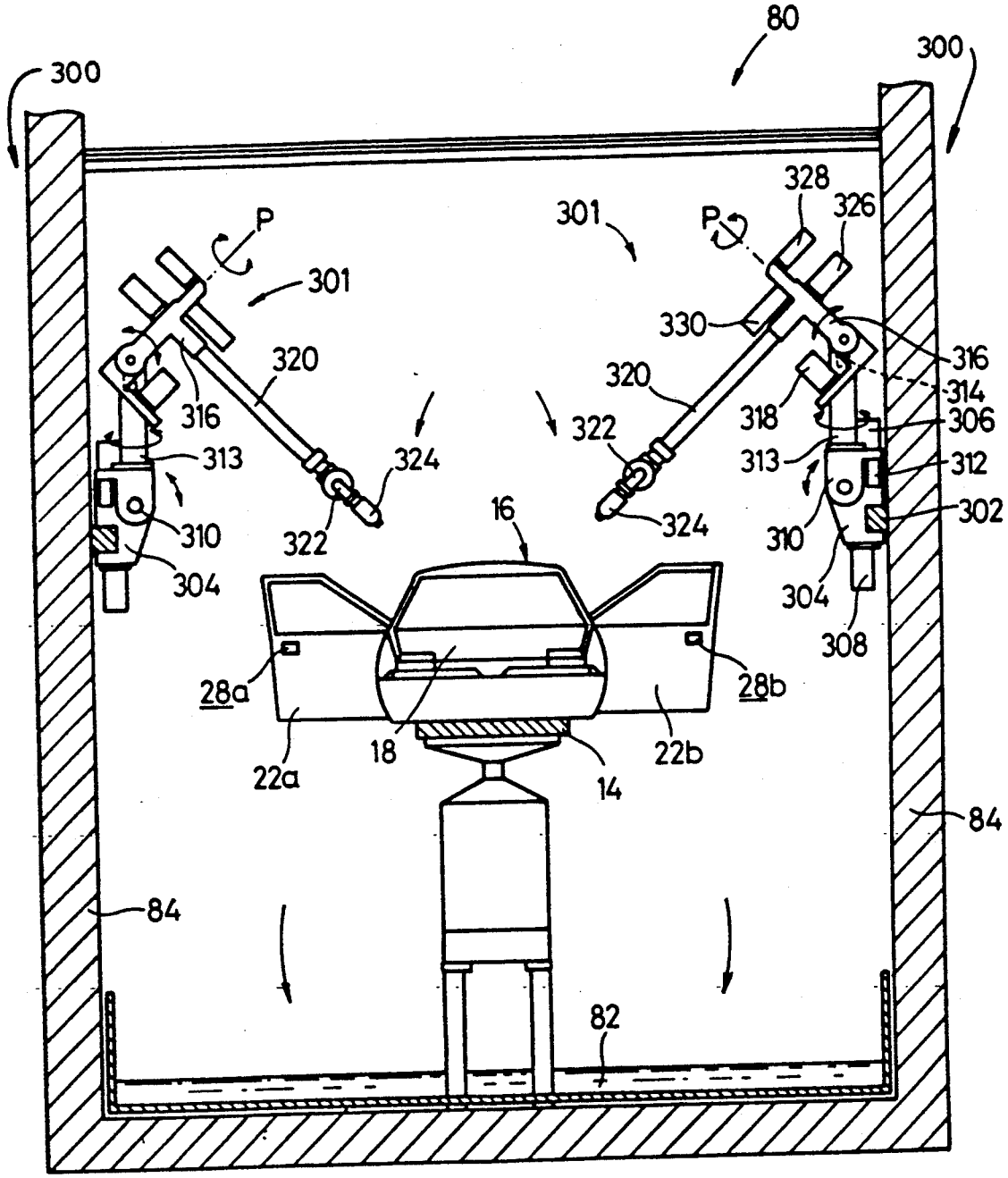
FIG. 12 is front elevational view of movable coating mechanisms of the coating apparatus.

As shown in FIG. 12, air is supplied into each of the coating booths 80 by an air blower means (not shown) and flows downwardly as indicated by the arrows in the coating booth 80 for forcing excessive paint into water 82 which flows on the bottom of the coating booth 80. Guide rails 302 of the movable coating mechanisms 300 are fixed to inner surfaces of opposite side walls 84 of the coating booth 80, the guide rails 302 extending in the direction in which the automotive body 16 is delivered. Each of the coating robots 301 of the coating mechanisms 300 has a movable base 304 which is movable back and forth along the guide rail 302 by a rotative drive source 306 mounted on the base 304. More specifically, the guide rail 302 may have a rack and a pinion meshing with the rack may be coupled to the rotative drive source 306.

A tilting motor 308 is mounted on the movable base 304 for tilting a first arm 310 angularly movably supported on the movable base 304. A turning motor 312 is supported on the first arm 310 and coupled to a turning shaft 313 with a tilting motor 314 mounted on the distal end thereof. A second arm 316 which is tiltable by the tilting motor 314 is coupled to the turning shaft 313. The second arm 316 is swingable about an axis P by a turning motor 318, and a rod 320 extends perpendicularly to the axis P. A wrist 322 is attached to the distal end of the rod 320, and a paint spray gun 324 is mounted on the wrist 322. The second arm 316 supports thereon a rotating motor 326 for rotating the wrist 322 as a whole, a tilting motor 328 for tilting the wrist 322, and a rotating motor 330 for rotating only the distal end of the wrist 322.

The movable coating mechanism 300*a* and the fixed coating mechanism 400 are located in the third station 12*c* on the righthand side of the direction in which the automotive body is conveyed, and the movable coating mechanism 300*b* is located on the lefthand side of the automotive body conveying direction. As illustrated in FIG. 1, the movable coating mechanisms 300*a*, 300*b* are similar in structure to the movable coating mechanisms 300. The movable coating robots 301*a* of the coating mechanism 300*a* each comprise movable bases 304*a*, 304*b* movable back and forth along a guide rail 302*a*, and paint spray guns 324*a*, 324*b* are mounted on the movable bases 304*a*, 304*b*, respectively, by rods 320*a*, 320*b*. The movable coating robots of the mechanism 300*b* each comprise movable bases 304*c* through 304*e* movable along a guide rail 302*b*, and paint spray guns 324*c* through 324*e* are mounted on the respective movable bases 304*c* through 304*e* by rods 320*c*, 320*e*.

Figure 13:
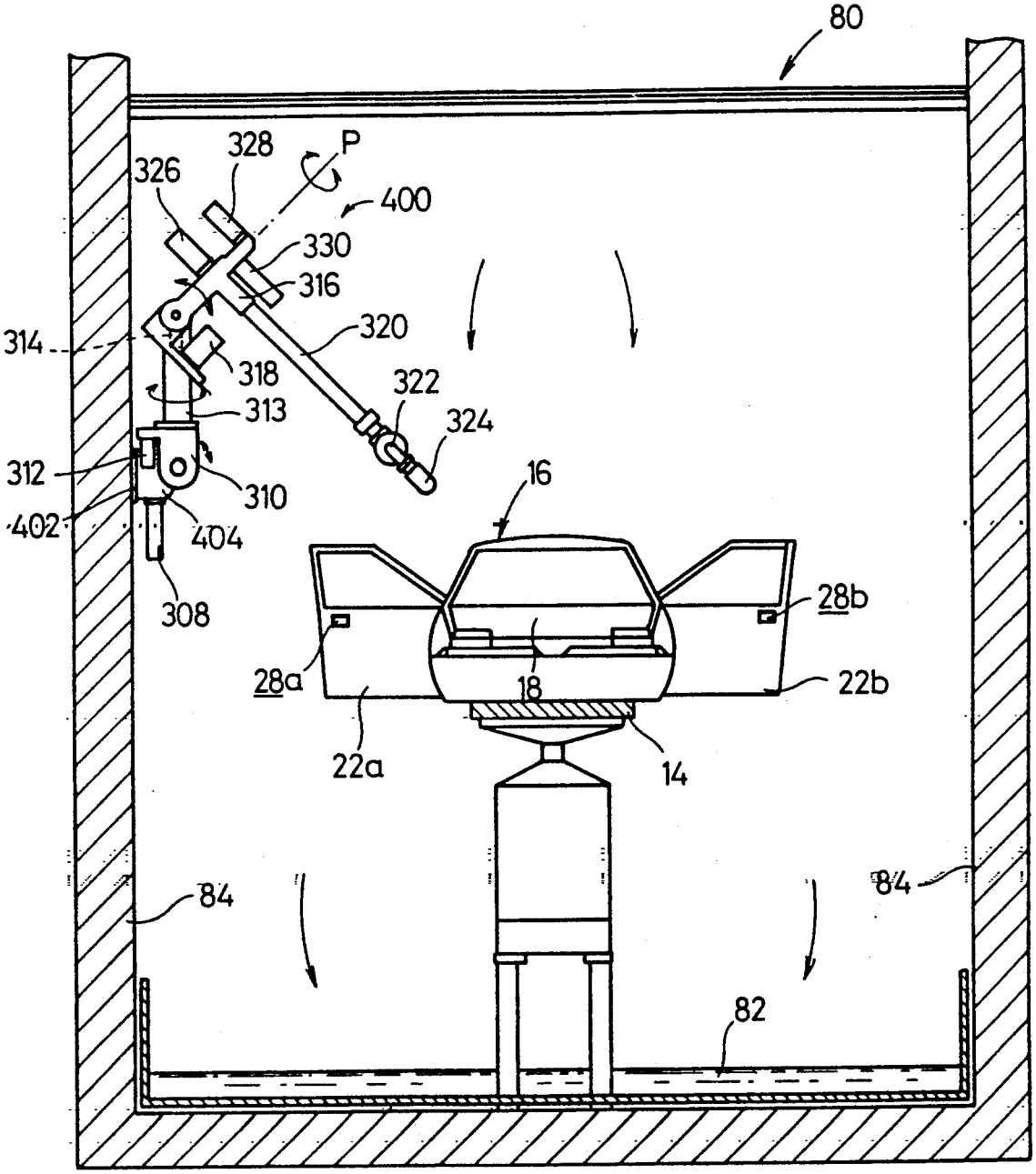
FIG. 13 is a front elevational view of a fixed coating mechanism of the coating apparatus.

As shown in FIG. 13, the fixed coating mechanism 400 includes a fixed pad 402 secured to an inner wall surface of a side wall 84 of the coating booth 80, and a fixed base 404 securely mounted on the fixed pad 402. Those parts of the fixed coating mechanism 400 which are identical to those of the movable coating mechanism 300 are denoted by identical reference numerals, and will not be described in detail.

The movable coating mechanism 300*c* in the fourth station 12*d* has a relatively long guide rail 302*c* and two movable bases 304*f*, 304*g* movably supported on the guide rail 302*c*. Paint spray guns 324*f*, 324*g* are mounted on the respective movable bases 304*f*, 304*g* by rods 320*f*, 320*g*.

Operation and advantages of the coating line incorporating the coating apparatus of the present invention will be described below.

Figure 7:
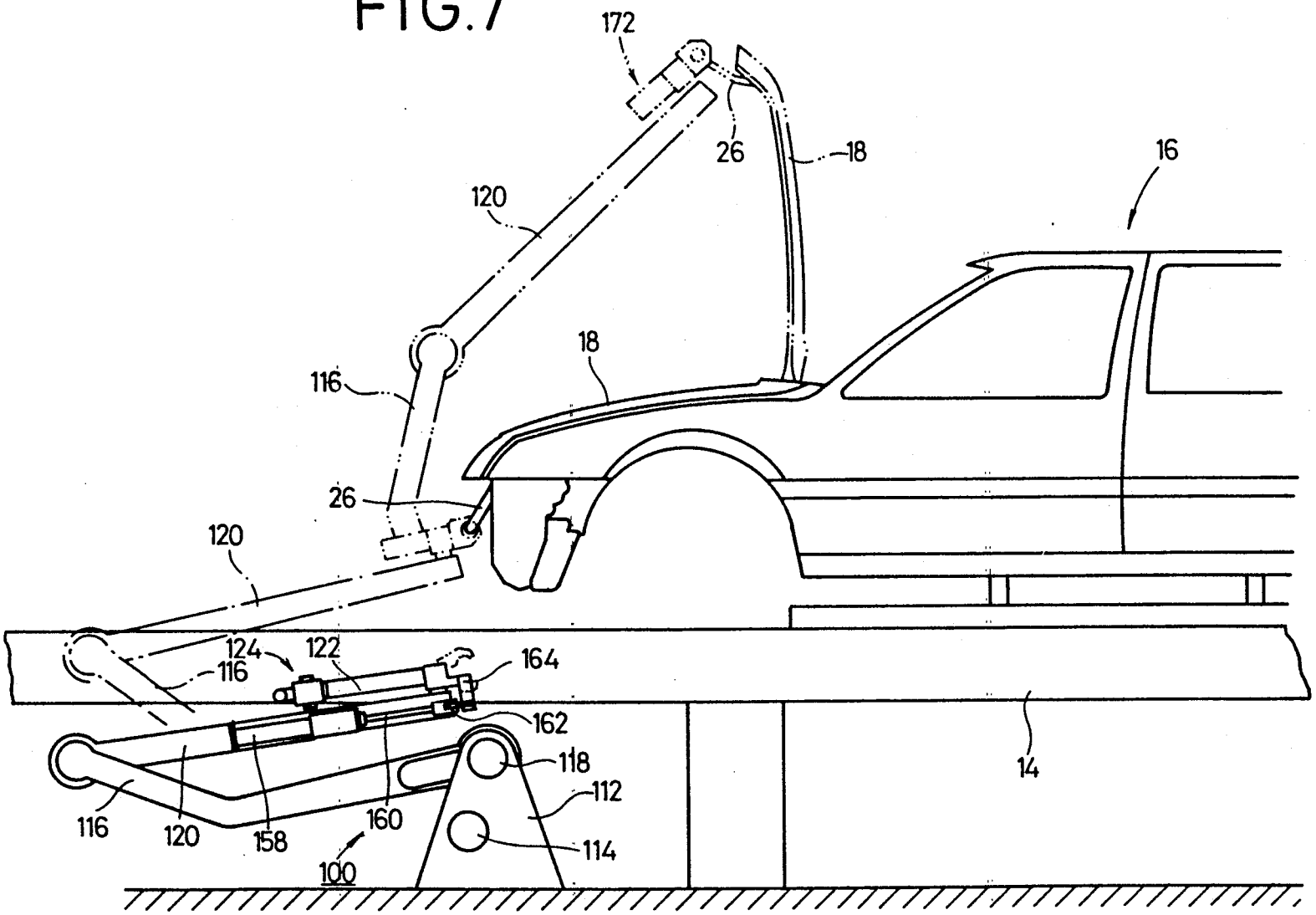
FIG. 7 is a side elevational view showing the manner in which an automotive engine hood is opened by the cover opening/closing mechanism.
Figure 8:
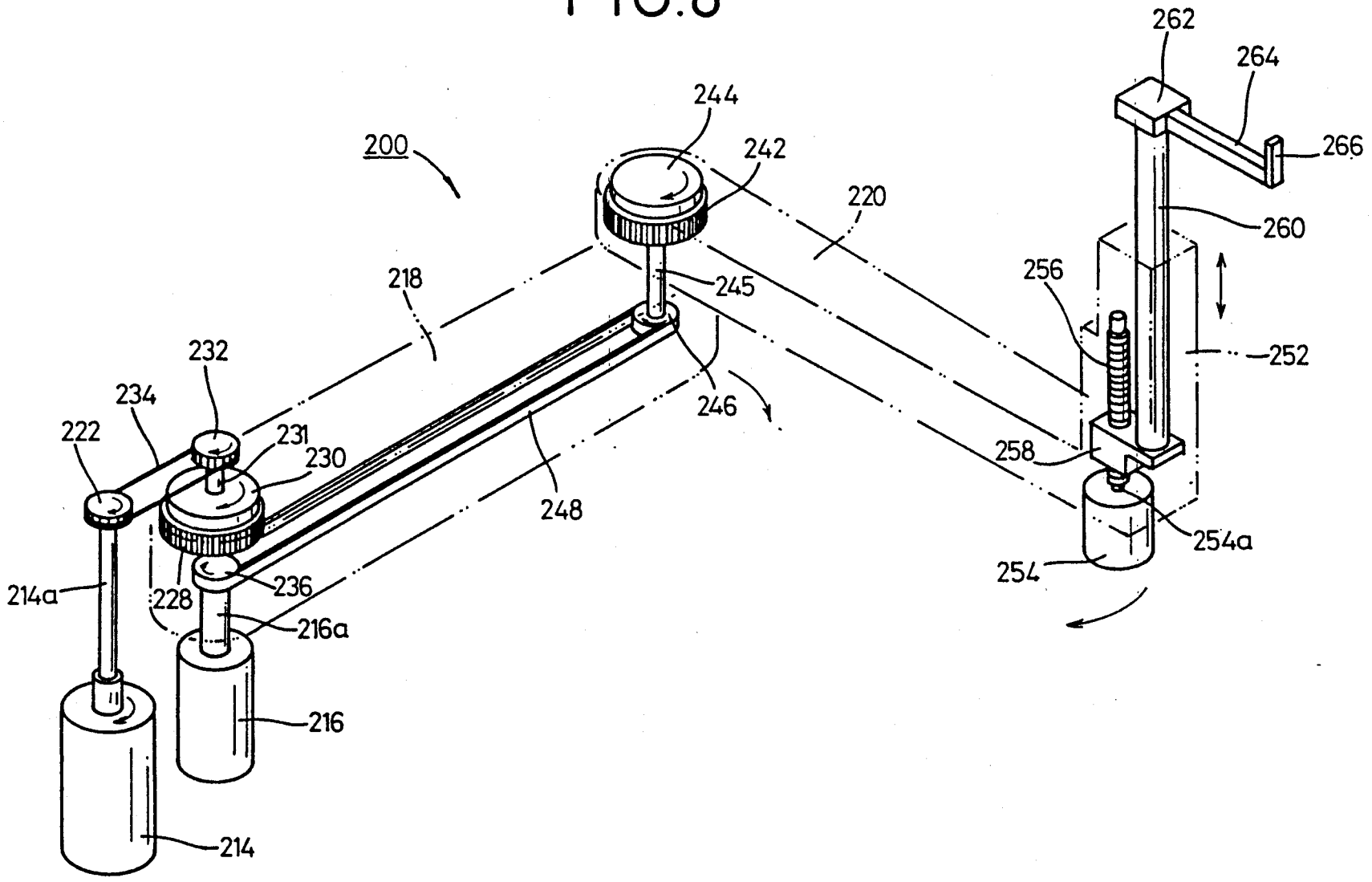
FIG. 8 is a perspective view, partly omitted from illustration, of a door opening/closing mechanism of the coating apparatus.
Figure 9:
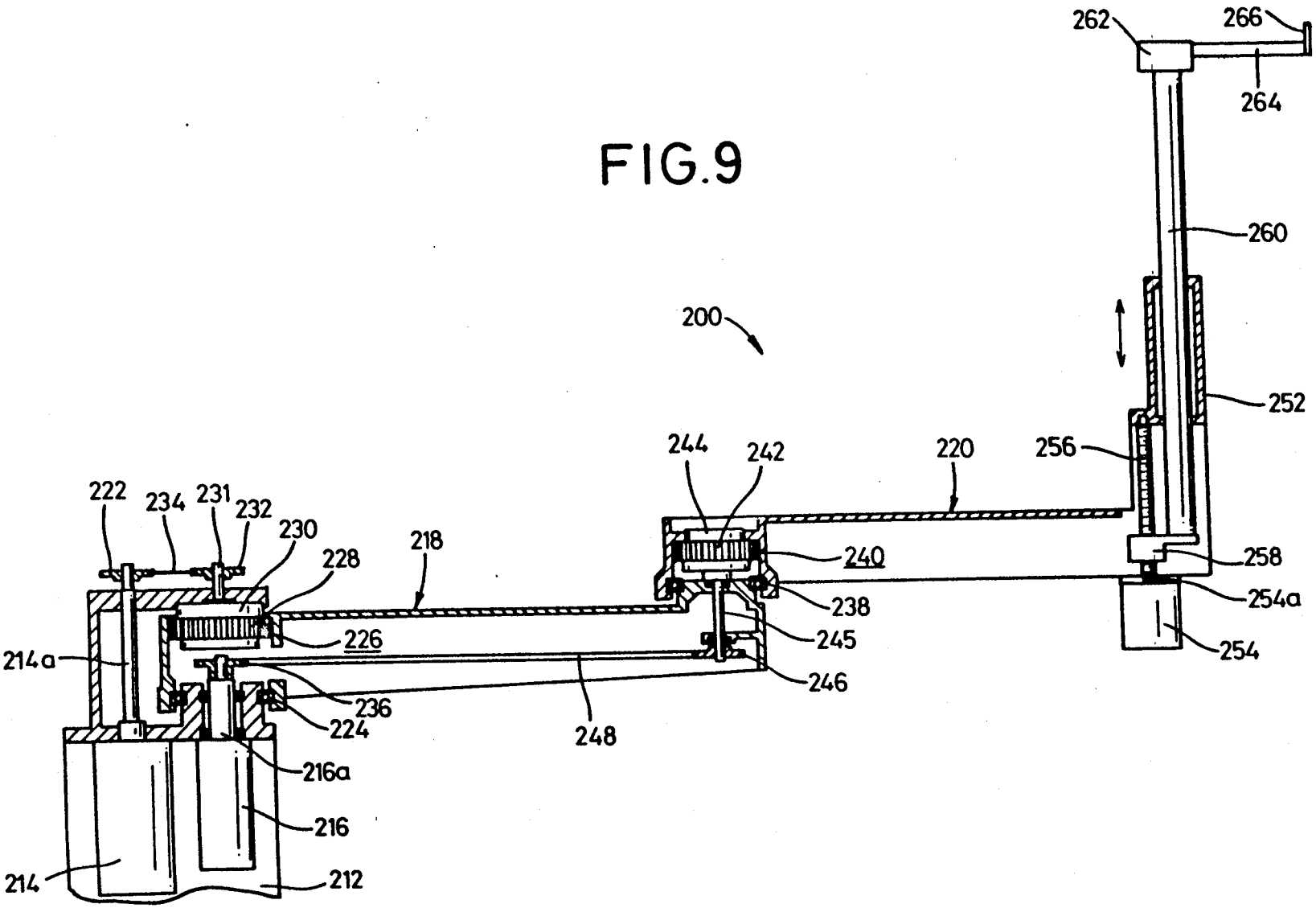
FIG. 9 is vertical cross-sectional view of the door opening/closing mechanism.
Figure 10:
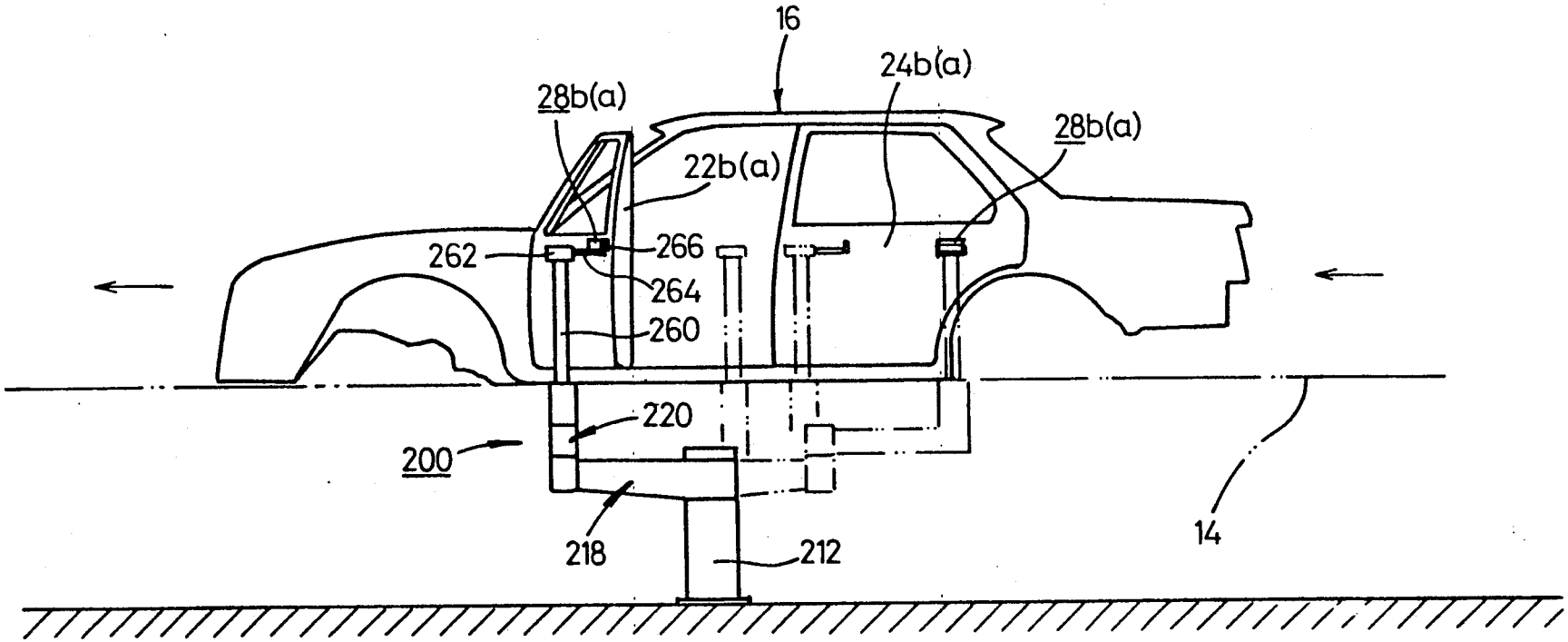
FIG. 10 is a schematic side elevational view of the door opening/closing mechanism which is disposed in a coating station.
Figure 11:
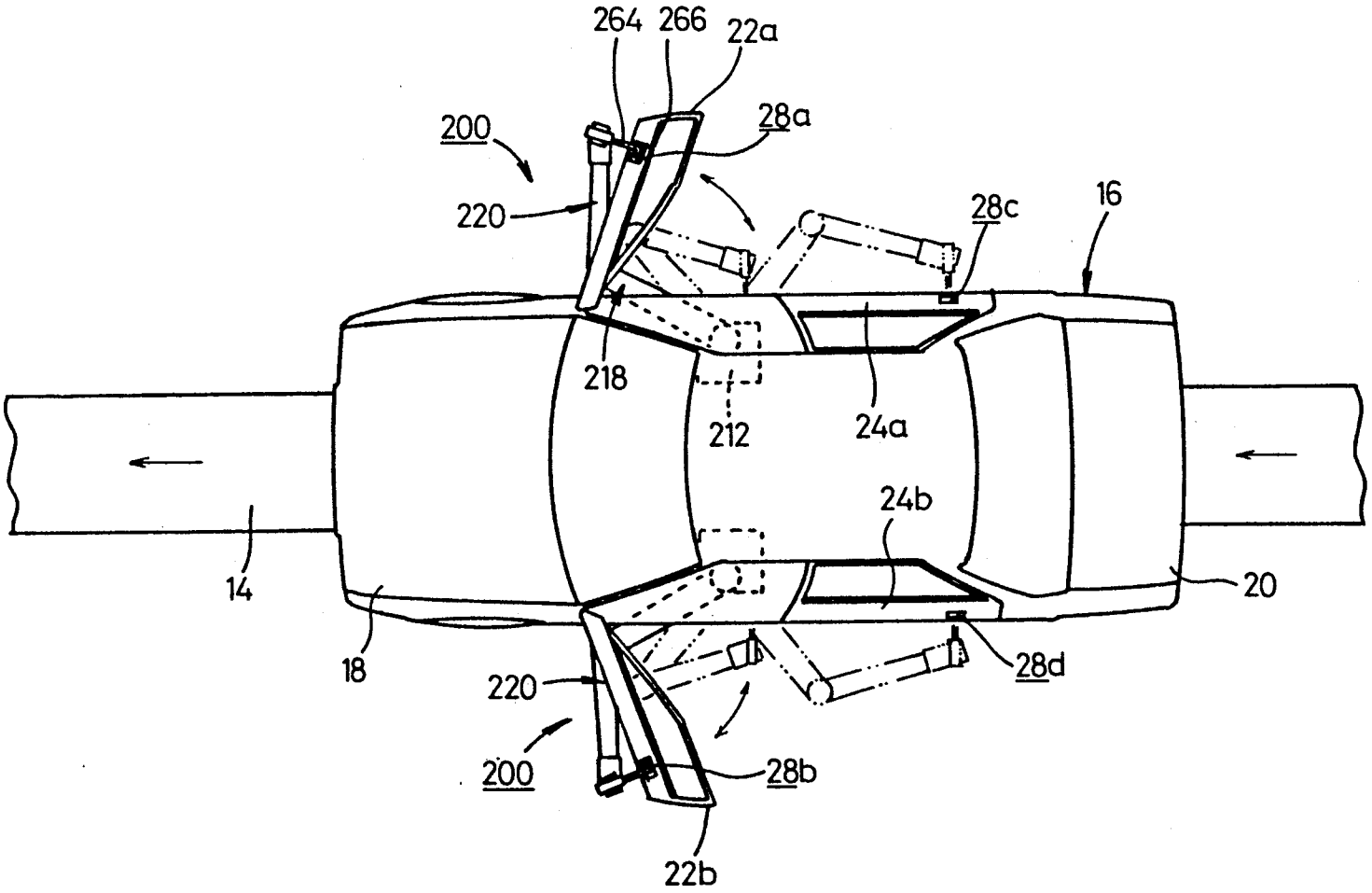
FIG. 11 is a schematic plan view of the coating station shown in FIG. 10.

While the automotive body 16 with the engine hood 18 and the trunk lid 20 being closed is being delivered on the conveyor 14, each of the cover opening/closing mechanisms 100 is in the standby condition as indicated by the solid lines in FIG. 7. The second arm 120 is folded down on the first arm 116 which extends substantially horizontally, and the piston rod 160 of the cylinder 158 on the second arm 120 is extended to its maximum stroke. At this time, the third arm 122 lies parallel to the axis of the second arm 120.

When the automotive body 16 reaches a predetermined position on the conveyor 14, the conveyor 14 is inactivated. Then, the door opening/closing mechanisms 200 and the cover opening/closing mechanisms 100 are operated to open the doors 22a, 22b, 24a, 24b, the engine hood 18, and the trunk lid 20.

Operation of the door opening/closing mechanism 200 disposed near the righthand front door 22a will first be described below. The first rotative drive source 214 is energized to rotate the drive shaft 214a in the direction indicated by the arrow in FIG. 8 to cause the first sprocket 222 and the chain 234 to rotate the second sprocket 232. The shaft 231 coupled to the second sprocket 232 is rotated to rotate the gear 228 coupled to the speed reducer 230 at a reduced speed in the direction indicated by the arrow. Therefore, the first arm 218 with the gear 228 fitted in the hole 226 thereof is angularly displaced about the bearing 224 horizontally in the direction indicated by the arrow.

The second rotative drive source 216 is energized to rotate the drive shaft 216a in the direction indicated by the arrow. The second pulley 246 is then rotated through the first pulley 236 and the belt 248, and the shaft 245 coupled to the second pulley 246 is rotated to rotate the gear 242 coupled to the speed reducer 244. The second arm 220 with the gear 242 fitted in the hole 240 thereof is now angularly displaced about the bearing 238 horizontally in the direction indicated by the arrow.

Figure 14:
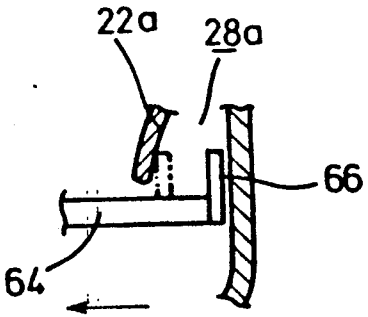
FIGS. 14(*a*) and 14(*b*) are fragmentary cross-sectional views showing the manner in which the door opening/closing mechanism operates.
Figure 14:
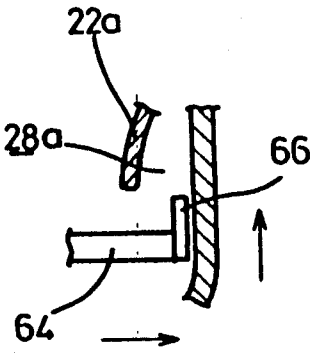

Therefore, the casing 252 mounted on the second arm 220 is displaced toward the righthand front door 22a of the automotive body 16 until the locking member 266 vertically movably mounted on the casing 252 enters the handle attachment opening 28a (see FIG. 14(*a*)).

Then, the third rotative drive source 254 is energized to rotate the drive shaft 254a and hence the ball screw 256 coupled thereto, thus displacing the nut 258 upwardly along the ball screw 256. When the nut 258 is moved upwardly, the rod 260 mounted thereon is also moved upwardly, and the engaging member 266 connected to the rod 260 is displaced upwardly into the handle attachment opening 28a (see FIG. 14(*b*)).

After the engaging member 266 has engaged in the handle attachment opening 28a, the first and second rotative drive sources 214, 126 are reversed. The first arm 218 is then angularly displaced in the direction opposite to the direction of the arrow through the gear 228 which is rotated by the first rotative drive source 214, and the second arm 220 is angularly displaced in the direction opposite to the direction of the arrow through the gear 242 which is rotated by the second rotative drive source 216. The first and second rotative drive sources 214, 216 are controlled to displace the engaging member 266 along a substantially arcuate path about the hinges of the righthand front door 22a for thereby opening the righthand front door 22a with respect to the automotive body 16.

The door opening/closing mechanism 200 disposed near the lefthand front door 22b is operated to bring the engaging member 266 into the handle attachment opening 28b in the lefthand front door 22b. The engaging member 266 is then displaced along a substantially arcuate path about the hinges of the lefthand front door 22b to open the lefthand front door 22b with respect to the automotive body 16.

The righthand and lefthand rear doors 24a, 24b are angularly displaced about their hinges so as to be opened by the respective door opening/closing mechanisms 200. The rear doors 24a, 24b and the front doors 22a, 22b are kept open by respective holders (not shown).

The engine hood 18 is opened as follows: The first and second arms 116, 120 of the cover opening/closing mechanism 100 which is positioned in front of the automotive body 16 are angularly displaced to the position indicated by the dot-and-dash lines in FIG. 7. More specifically, as shown in FIG. 6, the first motor 114 mounted on the support base 112 is energized. The rotation of the first motor 114 is transmitted through the belt 132 to the speed reducer 136 to turn the first arm 116 at a certain speed. At the same time, the second motor 118 is energized. The rotation of the second motor 118 is transmitted to the speed reducer 154 through the belts 144, 145, 148, 152 to turn the Second arm 120 at a certain speed. When the first and second arms 116, 120 reach the dot-and-dash-line position, the first and second motors 114, 118 are de-energized.

Then, the third arm 122 is turned toward the L-shaped handle 26 mounted on the front end of the engine hood 18 of the automotive body 16. Specifically, the cylinder 154 on the second arm 120 is actuated to retract the rod 160 for thereby causing the link 162 to turn the third arm 122 through 90° toward the automotive body 16 (see FIG. 4).

The gripper mechanism 124 on the distal end of the third arm 122 now reaches the position of the handle 26 on the engine hood 18. After the handle 26 has been detected by the light-reflecting sensor 174 of the gripper mechanism 14, the cylinder 166 is actuated to enable the chuck 172 to grip the handle 26.

Thereafter, the first and second arms 116, 120 are turned by the first and second motors 114, 118, respectively, so as to be extended to the position indicated by the two-dot-and-dash lines in FIG. 7, thereby opening the engine hood 18.

At this time, the first and second arms 116, 120 of the cover opening/closing mechanism 100 are positioned laterally and forwardly of the automotive body 16. The third arm 122 which has turned 90° toward the automotive body 16 with the gripper mechanism 172 gripping the handle 26 on the engine hood 18 is positioned forwardly of the automotive body 16. Therefore, foreign matter such as dust deposited on the surfaces of the first, second, and third arms 116, 120, 122 and grease applied to the movable parts of these arms 116, 120, 120 do not fall onto the automotive body 16. While the first and second arms 116, 120 are extended upwardly to open the engine hood 18, such foreign matter, if any, will fall into the engine compartment, and hence do not present an obstacle to the coating of the surfaces of the automotive body 16.

When the engine hood 18 is opened by the cover opening/closing mechanism 100, the engine hood 18 is held at a predetermined angle with respect to the automotive body 16 by the cover holder mechanism 30. More specifically, as the engine hood 18 is progressively opened from the closed position, the second connecting member 54 is swung upwardly about the pin 52 (see FIG. 3(*a*)). The third connecting member 60 pivotally coupled to the second connecting member 54 by the pin 58 is angularly displaced to move the stopper pin 62 on the third connecting member 60 in and along the first opening 36 in the direction indicated by the arrow in FIG. 3(*a*)). Further opening movement of the engine hood 18 causes the stopper pin 62 from the first opening 36 into the second opening 38 in the first connecting member 32.

At this time, the locking member 44 of the locking means 42 is tilted under the tension of the coil spring 50 such that the end 44*a* is biased toward the third opening 40 whereas the other end 44*b* is held against the inner wall surface which defines the second opening 38. Therefore, the stopper pin 62 moves along the lower surface of the end 44*b* of the locking member 44 and then engages the end 44*a* thereof, after which the stopper pin 62 turns the end 44*a* upwardly against the tension of the coil spring 50 until finally the stopper pin 62 enters the third opening 40 (see FIG. 3(*b*)). The stopper pin 62 is now retained in the third opening 40, whereupon the first and second connecting members 32, 54 are held in a fixed position by the third connecting member 60 with the stopper pin 62 mounted thereon. The engine hood 18 is thus kept in the predetermined angular position with respect to the automotive body 16 and prevented from being closed on the automotive body 16.

The trunk lid 20 can be opened by the corresponding cover opening/closing mechanism 100 and held at a certain angle with respect to the automotive body 16 by the cover holder mechanism 30 in the same manner as described above.

After the engine hood 18, the trunk lid 20, the front doors 22*a*, 22*b*, and the rear doors 24*a*, 24*b* have been opened in the first station 19*a*, the automotive body 16 is then delivered into the second station 12*b*. In the second station 12*b*, a front portion of the automotive body 16, a front portion of the roof thereof, and other areas of the automotive body 16 are coated by the movable coating mechanisms 300.

More specifically, the movable base of each of the movable coating mechanisms 300 is displaced along the guide rail 302 by the rotative drive source 306, and operation of the tilting motors 308, 314, 328, the turning motors 312, 318, and the rotating motors 326, 330 is controlled as desired. The first arm 310, the turning shaft 313, the second arm 316, the rod 210, and the wrist 322 are thus tilted, turned, and rotated to move the paint spray gun 324 along a desired path, while a paint spray is ejected from the paint spray gun 324 to apply a paint coating to the automotive body 16.

Even if the first arm 310 and the rod 320 are substantially brought in line with each other, since the rod 320 is turned about the axis P by the turning motor 318, the paint spray gun 324 mounted on the distal end of the rod 320 can move in a sufficiently large range.

When the paint spray gun 324 ejects a paint spray while the first arm 310 and the rod 320 are folded upon each other in a V shape, only the rod 320 can be turned by the turning motor 318 without turning the first arm 310. Therefore, any wobbling movement of the second arm 316 which supports the rod 320 can be minimized, and the second arm 316 and the turning shaft 313 are prevented from interfering with with other components in the coating booth 80 and the automotive body 16.

The turning shaft 313 coupled to the turning motor 312 and interposed between the first arm 310 and the second arm 316 serves to increase the range of movement of the paint spray gun 324.

As illustrated in FIG. 12, the guide rail 302 of each of the movable coating mechanisms 300 is fixed to the inner surface of the side wall 84 of the coating booth 80, and the movable base 304 is supported on the guide rail 302. Thus, the coating booth 80 is made compact in its entirety, and no floor is required at the lower portion of the coating booth 80 for installing the movable coating mechanism 300, so that an air stream flowing for preventing a paint mist from being scattered is not obstructed.

Figure 15:
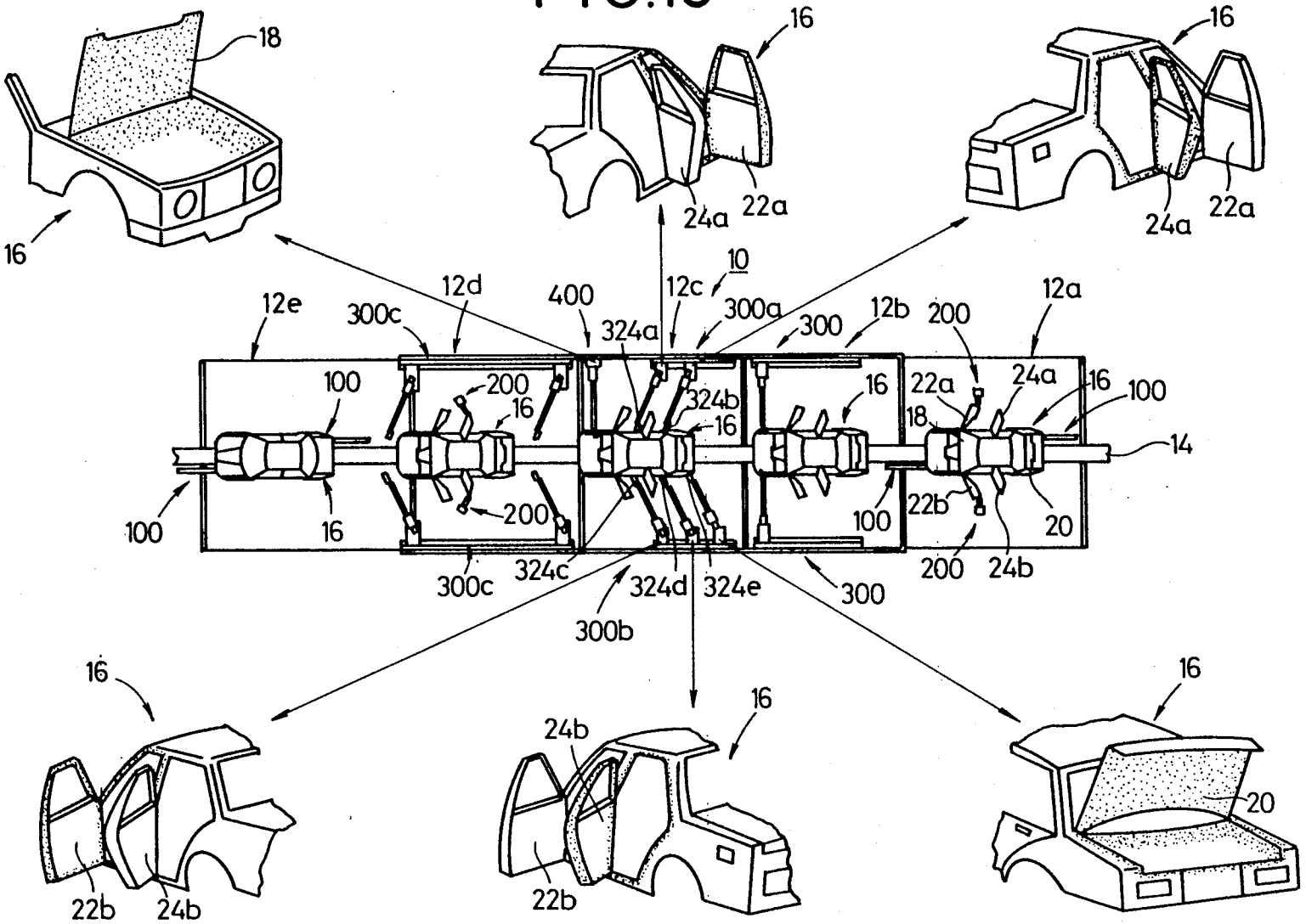
FIG. 15 is a view of coating mechanisms of the coating apparatus and automotive body body parts coated by the coating mechanisms.

After the automotive body 16 has been coated in the second station 12*b*, the automotive body 16 is delivered into the third station 12*c* by the conveyor 14. In the third station 12*c*, as shown in FIG. 15, the fixed coating mechanism 400 is operated to coat the inner panels of the engine compartment of the automotive body 16 and the reverse side of the engine hood 18. At the same time, a paint spray is ejected from the paint spray gun 324*a* of the movable coating mechanism 300*a* and applied to the inner panel of the front door 22*a* and a corresponding inner panel of the automotive body 16, and a paint spay is ejected from the paint spray gun 324*b* and applied to the inner panel of the rear door 24*a* and a corresponding inner panel of the automotive body 16.

The paint spray guns 324*c* through 324*e* of the movable coating mechanism 300*b* apply paint coatings to the inner panel of the front door 22*b*, a corresponding inner panel of the automotive body 16, the inner panel of the rear door 24*b*, a corresponding inner panel of the automotive body 16, the inner panel of the trunk, and the reverse side of the trunk lid 20.

The inner panels of the front doors 22*a*, 22*b* and the inner panels of the automotive body 16 which correspond to the rear doors 24*a*, 24*b* are coated simultaneously. If the front and rear inner panels of the automotive body 16 which correspond to the front doors 22*a*, 22*b* and the rear doors 24*a*, 24*b* were simultaneously coated, since the paint spray guns 324*a*, 324*b* and 324*c*, 324*d* are disposed closely to each other, paint sprays ejected from these paint spray guns would tend to be applied to various parts such as the paint spray guns 324*a* through 324*d*.

The inner panes of the automotive body 16 are coated on their entire surfaces by the movable coating mechanisms 300*a*, 300*b* and the fixed coating mechanism 400 while the automotive body 16 is held at rest in the third station 12*c*. Therefore, the inner panels of the automotive body 16, which have heretofore been coated in two stations or more, are simultaneously coated in the single third station 12*c*, so that the process of coating the automotive body 16 is made efficient. With the number of stations being reduced, the overall length of the coating line 10 is shortened.

The automotive body 16 which has been coated on the inner panels in the third station 12*c* is then delivered into the fourth station 12*d* by the conveyor 14. In the fourth station 12*d*, the righthand rear door 24*a* and the lefthand rear door 24*b* are closed by the door opening/closing mechanisms 200. More specifically, in order to close the righthand rear door 24*a*, the first and second rotative drive sources 214, 216 are energized to displace the first and second arms 218, 220 in the directions of the arrows in FIG. 8 to move the engaging member 266 substantially arcuately about the hinges of the righthand rear door 24*a*. The righthand rear door 24*a* which is engaged by the engaging member 266 is closed with respect to the automotive body 16. The third rotative source 254 is actuated to rotate the ball screw 256 coupled to the drive shaft 254a to cause the nut 258 to lower the rod 260 and the engaging member 266. The rotative drive sources 214, 216 are then energized to space the engaging member 266 away from the right-hand rear door 24a.

The lefthand rear door 24b can be closed with respect to the automotive body 16 by the corresponding door opening/closing mechanism 200.

After the rear doors 24a, 24b have been closed, the movable coating mechanisms 300c are operated to apply paint coatings to uncoated areas such as the hinges of the rear doors 24a, 24b, the reverse sides of the engine hood 18 and the trunk lid 20, and the inner panes of the trunk. The door opening/closing mechanisms 200 are then actuated to close the righthand and lefthand front doors 22a, 22b in the same manner as described above for closing the rear doors 24a, 24b.

Since the righthand front door 22a, for example, is opened and closed by the engine member 266 engaging in the handle attachment opening 28a in the door 22a, the righthand front door 22a can easily and reliably be opened and closed by the door opening/closing mechanism 200 which is of a simple arrangement.

More specifically, when opening and closing the righthand front door 22a, the engaging member 266 enters the handle attachment opening 28a which is much larger than the window glass receiving slot in the door 22a. Because it is only necessary to place the engaging member 266 in the large opening 28a for opening and closing the door 22a, any difficulty which would otherwise be experienced in putting an engaging jig into the narrow window glass receiving slot is eliminated. It is not necessary to provide a sensor for detecting the position of the opening 28a, or to place an auxiliary jig in the opening 28a in advance. Accordingly, the door opening/closing mechanisms 200 can economically be manufactured, and the doors can be opened and closed through an economical process. Since the righthand front door 22a is openable and closable with respect to the automotive body 16 about its hinges, the righthand front door 22a can smoothly be opened and closed simply by displacing the engaging member 266 of the door opening/closing mechanism 200 along a substantially arcuate path about the hinges.

The righthand front door 22a and the righthand rear opening/closing mechanisms 200 simply by positioning the automotive body 16 in a predetermined location. Thus, the automotive body 16 can be coated within a short period of time.

Thereafter, the automotive body 16 is delivered from the fourth station 12d to the fifth station 12e in which the engine hood 18 and the trunk lid 20 are closed. More specifically, the first and second arms 116, 120 are extended upwardly as indicated by the two-dot-and-dash lines in FIG. 7, and the gripper mechanism 172 is operated to grip the handle 26. Then, the engine hood 18 is further opened upwardly (FIG. 3(*b*)).

In the cover holder mechanism 30, the second and third connecting members 54, 60 are displaced in unison with each other. The stopper pin 62 on the third connecting member 60 turns the end 44a of the locking member 44 against the tension of the coil spring 50, and moves out of the third opening 40 and into the second opening 38. The stopper pin 62 is then moved toward the end of the second opening 38 and disengages from the engaging member 44 (see FIG. 3(*c*)). The end 44a of the locking member 44 is displaced toward the third opening 40 under the tension of the coil spring 50, thus creating a passage between the upper surface of the end 44a and the upper wall surface of the second opening 38.

Then, the engine hood 18 is angularly displaced toward the automotive body 16 to turn the second connecting member 54 about the pin 52 toward the first connecting member 32. Therefore, the stopper pin 62 on the third connecting member 60 is displaced in the second opening 38 along the upper surface of the end 44a of the locking member 44 in the direction indicated by the dot-and-dash-line arrow in FIG. 3(*c*). The stopper pin 62 then engages the upper surface of the other end 44b of the locking member 44, which is then moved downwardly against the tension of the coil spring 50. The stopper pin 62 moves along the upper surface of the end 44b from the second opening 38 into the first opening 36. As a result, by closing the engine hood 18 on the automotive body 16 with the cover opening/closing mechanism 100, the stopper pin 62 on the third connecting member 60 is displaced in and along the first opening 36. The engine hood 18 is now closed with respect to the automotive body 16.

The cover holder mechanism 30 may be reduced in size for easy handling. The engine hood 18 or other covers can be opened and closed through a simple procedure.

More specifically the first connecting member 32 of the cover holder mechanism 30 engages the automotive body 16, and the second connecting member 54 thereof engages the reverse side of the engine hood 18. The cover holder mechanism 30 thus constructed is smaller and lighter than a conventional holder mechanism which engages a carriage which places an automotive body thereon and the engine hood of the automotive body. The cover holder mechanism 30 can be attached and detached simply and quickly without the danger of damage to the outer panels of the automotive body 16.

When the engine hood 18 reaches a prescribed angular position with respect to the automotive body 16, the engine hood 18 is positioned and held in place by the coaction of the engaging member 42 and the stopper pin 62. The stopper pin 62 can automatically be released from the engaging means 42 simply by displacing the engine hood 18 further in the opening direction, after which the engine hood 18 can be closed on the automotive body 16. Consequently, the engine hood 18 and other covers can efficiently be opened and closed.

The cover holder mechanism 30 may be small in size, is simple in construction, and hence can be manufactured inexpensively.

Figure 16:
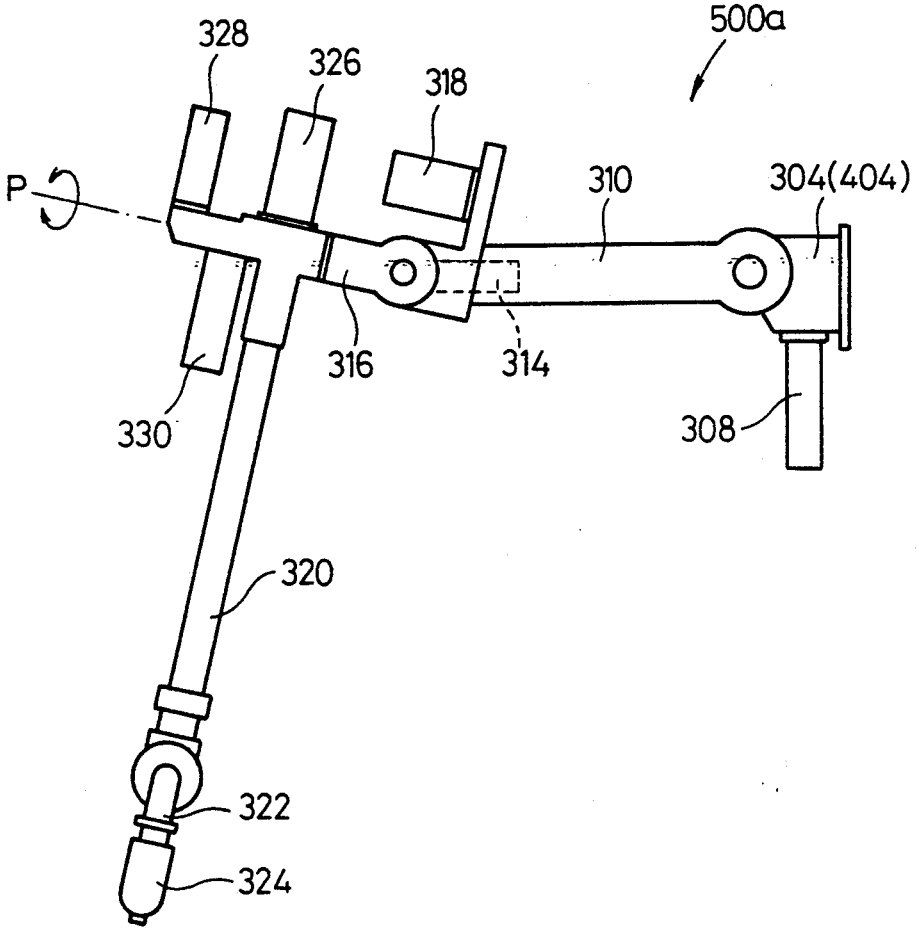
FIGS. 16 and 17 are views of coating mechanisms according to second and third embodiments of the present invention.
Figure 17:
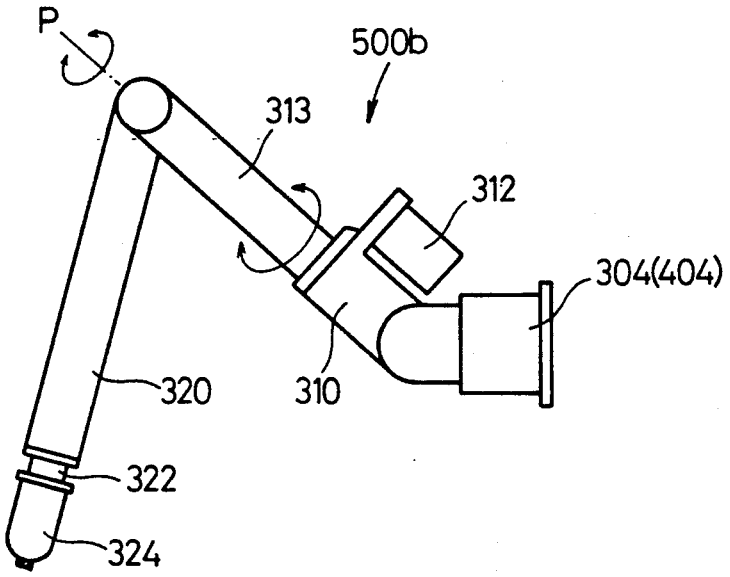

Each of the movable coating mechanisms 300, 300a through 300c and the fixed coating mechanism 400 shown in FIGS. 12 and 13 may be replaced with a coating mechanism 500a shown in FIG. 16 according to a second embodiment of the present invention or a coating mechanism 500b shown in FIG. 17 according to a third embodiment of the present invention. Those components in FIGS. 16 and 17 which are identical to those of the movable coating mechanisms 300 are denoted by identical reference numerals, and will not be described in detail.

The coating mechanism 500a shown in FIG. 16 does not employ the turning shaft 313, but allows the paint spray gun 324 to be displaced in a desired range without being affected by the angle formed between the first arm 310 and the rod 320.

In the coating mechanisms 500a, 500b, since the rod 320 is angularly displaceable about the axis P, any wobbling movement of the rear portion of the rod 320 is small, and the rod 320 is prevented from interfering with other components.

Figure 18:
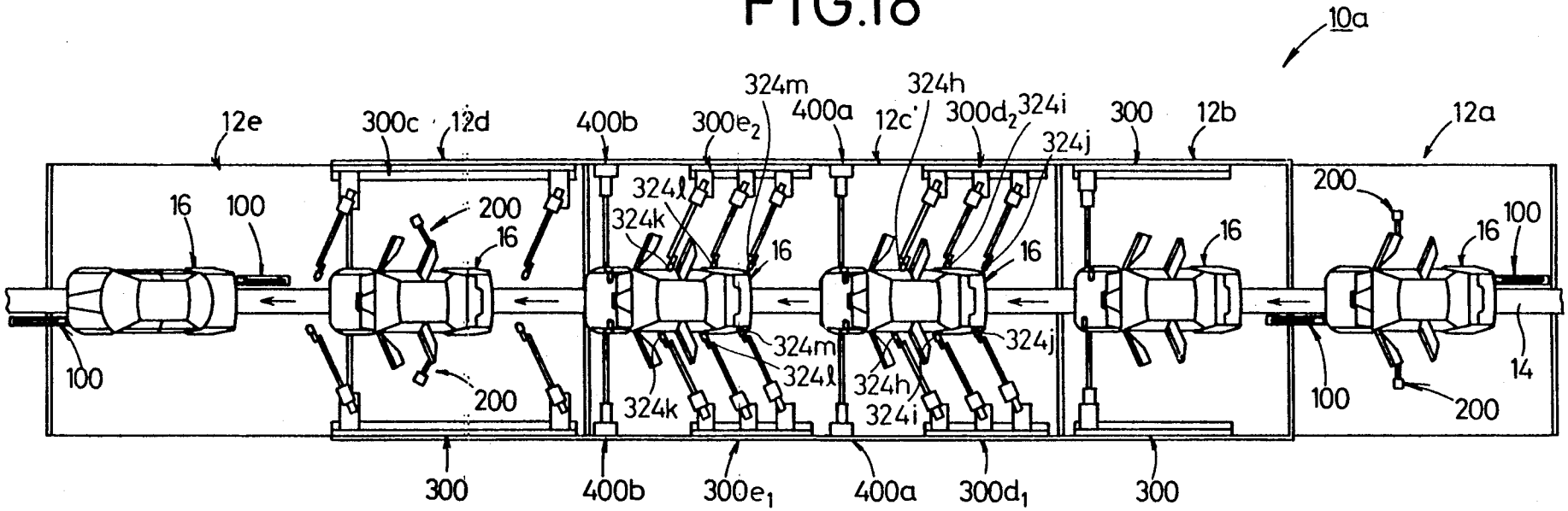
FIG. 18 is a schematic plan view of another coating line incorporating a coating apparatus according to the present invention.

FIG. 18 shows another coating line 10*a* incorporating a coating apparatus of the present invention. The coating line 10*a* includes a third station 12*c'* which has first movable coating mechanisms 300*d*$_1$, 300*d*$_2$, first fixed coating mechanisms 400*a*$_1$, 400*a*$_2$, second movable coating mechanisms 300*e*$_1$, 300*e*$_2$, and second fixed coating mechanisms 400*b*$_1$, 400*b*$_2$ which are arranged along the conveyor 14.

When an automotive body 16 with its engine hood 18, trunk lid 20, front doors 22*a*, 22*b*, and rear doors 24*a*, 24*b* being open is delivered from the second station 12*b* to the third station 12*c'*, the lefthand half of the reverse side of the engine hood 18 is coated by the lefthand first fixed coating mechanisms 400*a*$_1$, and the righthand half of the inner panel of the engine compartment is coated by the righthand first fixed coating mechanism 400*a*$_2$.

The inner panel of the lefthand front door 22*b*, an inner panel of the automotive body 16 which corresponds to the lefthand rear door 24*b*, and the lefthand half of the inner panel of the trunk are coated by paint spray guns 324*h* through 324*j* of the lefthand first movable coating mechanism 300*d*$_1$. An inner panel of the automotive body 16 which corresponds to the righthand front door 22*a*, the inner panel of the righthand rear door 24*a*, and the righthand half of the reverse side of the trunk lid 20 are coated by paint spray guns 324*h* through 324*j* of the righthand first movable coating mechanism 300*d*$_2$.

Then, the automotive body 16 is delivered a certain distance and stopped in the third station 12*c'*. The lefthand half of the inner panel of the engine compartment and the righthand half of the reverse side of the engine hood 18 are thereafter coated by the lefthand second fixed coating mechanism 400*b*$_1$ and the righthand second fixed coating mechanism 400*b*$_2$. An inner panel of the automotive body 16 which corresponds to the lefthand front door 22*b*, the inner panel of the lefthand rear door 24*b*, and the lefthand half of the reverse side of the trunk lid 20 are coated by paint spray guns 324*k* through 324*m* of the lefthand second movable coating mechanism 300*e*$_1$. The inner panel of the righthand front door 22*a*, an inner panel of the automotive body 16 which corresponds to the righthand rear door 24*a*, and the righthand half of the inner panel of the trunk are coated by paint spray guns 324*k* through 324*m* of the lefthand first movable coating mechanism 300*e*$_2$.

In the third station 12*c'*, the ranges in which the paint spray guns 324*h* through 324*m* move are small during the coating process, and these paint spray guns are displaced along simple paths in the coating process. Therefore, the coating process can be performed easily and highly efficiently within a short period of time. Since the paint spray guns 324*h* through 324*m* are not displaced closely to each other during the coating operation, they are prevented from interfering with each other.

With the present invention, as described above, an automotive body with its engine good, trunk lid, and doors being open is delivered into a coating station, then stopped in the coating station, and desired inner panels of the automotive body are coated on their entire surfaces, after which the automotive body is fed to another station. Inasmuch as the inner panels of the automotive body which have heretofore been coated in a plurality of coating stations are coated in the single coating station, the coating process can be effected within a short period of time. Accordingly, the overall length of the coating line may be reduced.

Two coating mechanisms are disposed in the single coating station, and two divided areas of the inner panels are coated by the respective coating mechanisms. Consequently, the coating operation of each of the coating mechanisms is simplified, and the entire coating process is rendered highly efficient.

Furthermore, the engine hood, trunk lid, and doors of an automotive which is delivered along the coating line are automatically opened, then desired inner panels of the automotive body are coated, and thereafter the engine hood, trunk lid, and doors are automatically closed, after which the automotive body is delivered to another process. By simultaneously coating the inner panels of the front doors and the inner panels of the automotive body which correspond to the front doors, paint sprays ejected from the paint spray guns are prevented from being applied the paint spray guns, and the inner panels of the automotive body can be coated automatically and efficiently.

Moreover, the engaging member is placed into the handle attachment opening in a door of the automotive body, then displaced along a substantially arcuate path to open the door with respect to the automotive body, thereafter the inner peripheral walls of the door are coated, and then the engaging member is displaced in the opposite direction to close the door. When opening and closing the door, a narrow window glass receiving slot in the door is not used for receiving the engaging member, and it is not necessary to employ a slot detecting sensor which would otherwise be used to guide an engaging jig into the window glass receiving slot. The door can thus be opened and closed easily and reliably by a door opening/closing mechanism which is quite simple in structure. As a result, the door opening/closing mechanism can be manufactured inexpensively, and the door can be opened and closed efficiently. Since the engaging member is inserted to engage the reverse side of a panel defining the handle attachment opening, any coated layer is not damaged by the engaging member.

Furthermore, a cover such as an engine hood is opened by upwardly extending arms of a cover opening/closing mechanism on one side of an automotive body, and closed by downwardly folding the arms. Foreign matter such as dust does not fall onto the automotive body from the arms while the cover opening/closing mechanism is in operation. Subsequent coating operation can thus be effected smoothly without fail to provide high-quality coating layers.

A cover holder mechanism according to the present invention comprises a first connecting member to be mounted on an automotive body, a second connecting member angularly movably coupled to the first connecting member and adapted to be fixed to a cover such as an engine hood, and a third connecting member supported on the second connecting member and engageable with a locking means. Since the cover holder mechanism is directly mounted on the automotive body, the cover holder mechanism is small in size, light in weight, and can be manufactured inexpensively.

After the cover is held in a predetermined angular position by the locking means, the cover can be released from the locking means simply by being further opened. The cover can therefore be opened and closed easily automatically.

Each coating mechanism is mounted on an inner surface of a wall of a coating booth in overhanging relation. This arrangement allows the coating booth to be reduced in size. Because the bottom of the coating booth is not closed, air can smoothly flow through the coating booth to prevent paint sprays from being scattered and from contaminating an automotive body and the coating mechanisms.

Although certain preferred embodiments have been shown and described, it should be understood that many changes and modifications may be made therein without departing from the scope of the appended claims.

What is claimed is:

1. A coating apparatus for coating the automotive body of a 4-door automobile, comprising:

a coating station for coating the inner panels of the automotive body of said 4-door automobile, said automotive body being stopped in said coating station and having its doors open;

a plurality of coating robots positioned parallel to said automotive body alongside a direction of conveyance thereof, said coating robots being respectively positioned for coating the inner panels of the doors of said automotive body and the inner panels of the automotive body which correspond to said doors;

wherein each of said coating robots comprise:

a base;

a first arm supported on said base and angularly movably disposed along a first axis;

a second arm supported on a connecting means extending between said first arm and said second arm, said second arm being angularly movably disposed along a second axis;

a rotating means connected to said second arm and rotatably supporting a paint spray gun thereon.

2. A coating apparatus according to claim 1, further comprising at least one additional coating robot, constructed identically to each of said plurality of coating robots, said additional coating robot being positioned on at least one side of said automotive body for coating a trunk lid inner surface and the inner panels of the automotive body which correspond to said trunk lid.

3. A coating apparatus according to claim 1, further comprising two coating mechanisms positioned alongside said direction of conveyance on respective sides of said automotive body, each of said coating mechanisms comprising a plurality of said coating robots; wherein said first coating mechanism is positioned for coating the inner panels of front and rear doors and the inner panels of said automotive body corresponding to said front and rear doors on one side of said automotive body; and said second coating mechanism is positioned for coating the inner panels of front and rear doors and the inner panels of said automotive body corresponding to said front and rear doors located on another side of said automotive body.

4. A coating apparatus according to claims 1, 2 or 3, wherein the bases of said plurality of coating robots are respectively positioned above the roof of said automotive body.

5. A coating apparatus according to claims 1, 2 or 3, wherein the bases of said plurality of coating robots comprises movable bases.

6. A coating apparatus according to claims 1, 2 or 3, wherein said connecting means comprises a turning shaft extending between said first and second arms, said turning shaft being rotatable about said first axis.

7. A coating apparatus according to claims 1, 2 or 3, wherein said rotating means comprises a rod extending from said second arm and having a wrist attached to a distal end thereof, said wrist rotatably supporting said paint spray gun thereon.

* * * * *